US008182318B2

(12) United States Patent
Soma et al.

(10) Patent No.: US 8,182,318 B2
(45) Date of Patent: May 22, 2012

(54) OBLIQUELY GROOVED GRINDING WHEEL AND METHOD FOR MANUFACTURING THE SAME

(75) Inventors: Shinji Soma, Handa (JP); Masahiro Ido, Kariya (JP); Hitoshi Akahane, Anjo (JP); Tomohiro Inagaki, Anjo (JP); Yasuji Kunihiro, Hekinan (JP); Tomoyasu Imai, Kariya (JP)

(73) Assignees: Jtekt Corporation, Osaka-shi (JP); Toyoda Van Moppes Ltd., Okazaki-shi (JP)

( * ) Notice: Subject to any disclaimer, the term of this patent is extended or adjusted under 35 U.S.C. 154(b) by 526 days.

(21) Appl. No.: 12/446,313

(22) PCT Filed: Oct. 24, 2007

(86) PCT No.: PCT/JP2007/070720

§ 371 (c)(1),
(2), (4) Date: Apr. 20, 2009

(87) PCT Pub. No.: WO2008/056539

PCT Pub. Date: May 15, 2008

(65) Prior Publication Data

US 2010/0317267 A1 Dec. 16, 2010

(30) Foreign Application Priority Data

Nov. 6, 2006 (JP) ..... 2006-300415
Jul. 12, 2007 (JP) ..... 2007-183240

(51) Int. Cl.
*B24D 5/10* (2006.01)

(52) U.S. Cl. ..... 451/542; 451/544

(58) Field of Classification Search ..... 451/540–544, 451/547; 51/293, 297, 298
See application file for complete search history.

(56) References Cited

U.S. PATENT DOCUMENTS 3,916,579 A * 11/1975 Waller et al. ..... 451/547
5,611,724 A * 3/1997 deGraaff ..... 451/53

(Continued)

FOREIGN PATENT DOCUMENTS

CN 1118354 C 8/2003

(Continued)

OTHER PUBLICATIONS

Chinese Office Action issued Mar. 2, 2011, in Patent Application No. 200780039246.8 (with English-language translation).

(Continued)

*Primary Examiner* — Dung Van Nguyen
(74) *Attorney, Agent, or Firm* — Oblon, Spivak, McClelland, Maier & Neustadt, L.L.P.

(57) ABSTRACT

In a manufacturing method for a grinding wheel in which a plurality of wheel chips each composed of an abrasive grain layer containing superabrasive grains and a foundation layer are adhered to a core attached to a wheel spindle carried by a wheel head of a grinding machine to be drivingly rotatable about a rotational axis and in which a grinding surface formed on the abrasive grain layers grinds a workpiece, drivingly rotatably supported by a workpiece support device of the grinding machine, in contact at a grinding point, the method forms green wheel chips each having opposite ends in a wheel circumferential direction inclined relative to the wheel circumferential direction, bakes the green wheel chips to form baked wheel chips, and adheres the plurality of baked wheel chips to the core so that an oblique groove is formed between adjoining abrasive grain layers.

4 Claims, 22 Drawing Sheets

U.S. PATENT DOCUMENTS

| | | | | |
|---|---|---|---|---|
| 6,019,666 | A | 2/2000 | Roberts et al. | |
| 7,824,246 | B2 * | 11/2010 | Inagaki et al. | 451/9 |
| 8,033,278 | B2 * | 10/2011 | Kitajima et al. | 125/15 |

FOREIGN PATENT DOCUMENTS

| | | |
|---|---|---|
| JP | 61 257777 | 11/1986 |
| JP | 62 278207 | 12/1987 |
| JP | 9 193024 | 7/1997 |
| JP | 2000 176828 | 6/2000 |
| JP | 2000 354969 | 12/2000 |
| JP | 2002 504864 | 2/2002 |
| JP | 2006-142455 | 6/2006 |
| WO | WO 98/50201 | 11/1998 |

OTHER PUBLICATIONS

U.S. Appl. No. 12/443,545, filed Mar. 30, 2009, Soma, et al.
U.S. Appl. No. 12/442,627, filed Mar. 24, 2009, Ido, et al.
U.S. Appl. No. 12/421,063, filed Apr. 9, 2009, Mizutani, et al.

* cited by examiner

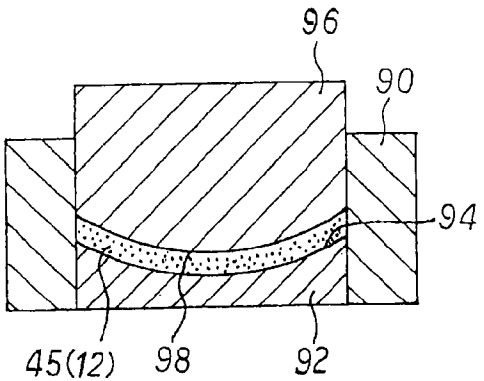
FIG. 27(b)
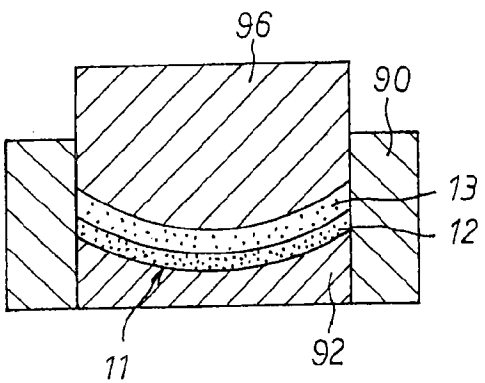
FIG. 27(d)
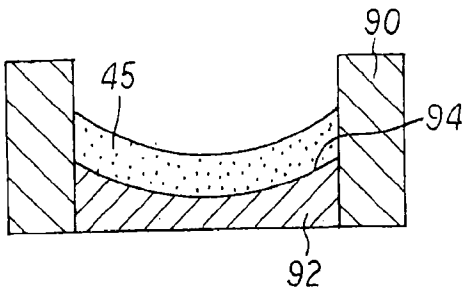
FIG. 27(a)
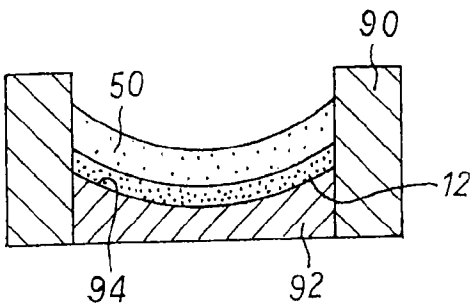
FIG. 27(c)
FIG. 28
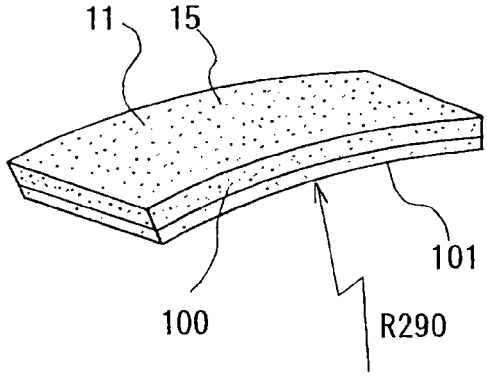

OBLIQUELY GROOVED GRINDING WHEEL AND METHOD FOR MANUFACTURING THE SAME

TECHNOLOGICAL FIELD

The present invention relates to an obliquely grooved grinding wheel and a manufacturing method therefor in which oblique grooves are formed on a grinding surface of a grinding wheel with segmented wheel chips adhered to a core.

BACKGROUND ART

Japanese Unexamined, Published Patent Application No. 2000-354969 (paragraphs [0007], [0026] and FIG. 1) describes a grooved grinding wheel in which an abrasive grain layer containing superabrasive grains such as diamond, cubic boron nitride or the like is formed on an outer circumferential surface of a disc-like core drivingly rotatable about an axis and in which oblique grooves having predetermined width and depth are formed on a circumferential grinding surface of the abrasive grain layer to be inclined in a range of 25 degrees through 45 degrees or so relative to the axis of the core. With the grooved grinding wheel like this, it becomes possible to effectively lead coolant along the oblique grooves to a grinding point and to enhance the grinding efficiency by increasing the grinding removal amount as much as about one and a half times in comparison with a grinding wheel with no oblique grooves.

Further, coolant supplied to a grinding point causes a dynamic pressure to be generated between a workpiece and a grinding wheel. In order to prevent machining accuracy and efficiency from being deteriorated as a result of such a dynamic pressure causing the workpiece to be displaced relative to the grinding wheel, it is contemplated to release the dynamic pressure by providing grooves on a grinding surface of the grinding wheel.

DISCLOSURE OF THE INVENTION

Problem to be Solved by the Invention

Where in order to provide the grooves on the grinding surface of the grinding wheel, oblique grooves are cut by machining on the grinding surfaces of wheel chips which are baked and adhered to a core after press-forming superabrasive grains and a bonding agent, the oblique grooves are machined on abrasive grain layers in which superabrasive grains are held strongly by the bonding agent, and thus, the machining is difficult because a grooving grinding wheel wears excessively. Further, where the oblique grooves are cut by machining on the abrasive grain layers of the wheel chips after baking, the retention force of superabrasive grains which are exposed to the grinding surface at lateral wall portions adjacent to each groove is weakened by the machining, so that the superabrasive grains become liable to fall off.

The present invention is intended to make it possible to provide easily and at a low cost a grinding wheel which is provided on a grinding surface thereof with oblique grooves formed without weakening the retention force of superabrasive grains on the grinding surface.

Measures for Solving the Problem

In order to solve the aforementioned problem, the features in construction of the invention in a first aspect reside in a manufacturing method for a grinding wheel in which a plurality of wheel chips each composed of an abrasive grain layer containing superabrasive grains and a foundation layer are adhered to a core attached to a wheel spindle carried by a wheel head of a grinding machine to be drivingly rotatable about a rotational axis and in which a grinding surface formed on the abrasive grain layers grinds a workpiece, drivingly rotatably supported by a workpiece support device of the grinding machine, in contact at a grinding point, the method comprising a wheel chip forming step of forming green wheel chips each having opposite ends in a wheel circumferential direction inclined relative to the wheel circumferential direction, a baking step of baking the green wheel chips to form baked wheel chips, and an adhering step of adhering the plurality of baked wheel chips to the core so that an oblique groove is formed between adjoining abrasive grain layers.

The features in construction of the invention in a second aspect reside in that in the first aspect, the wheel chip forming step comprises forming the opposite ends in the wheel circumferential direction to be inclined relative to the wheel circumferential direction and of forming a protruding portion by protruding the foundation layer from the abrasive grain layer in the wheel circumferential direction, and that the adhering step comprises adhering the plurality of baked wheel chips to the core so that the oblique groove is formed between adjoining abrasive grain layers by contacting the protruding portion of each baked wheel chip with the foundation layer of an adjoining wheel chip.

The features in construction of the invention in a third aspect reside in that in the first aspect, the wheel chip forming step comprises providing a press-forming mold which is provided with an arc-shape grinding surface forming wall for forming the grinding surface of the wheel chip, both lateral surface forming walls upstanding from the grinding surface forming wall in an upright direction and forming both lateral surfaces parallel to the wheel circumferential direction of the wheel chip, and forward and rearward end surface forming walls upstanding from the grinding surface forming wall in the upright direction and obliquely crossing the both lateral surface forming walls for forming a forward end surface and a rearward end surface in the wheel rotational direction of the wheel chip respectively inclined relative to the wheel circumferential direction, filling the press-forming mold with abrasive grain layer powder being a mixture of numerous superabrasive grains and a bonding agent, filling foundation layer powder being a mixture of foundation particles and a bonding agent to be placed on the abrasive grain layer powder, press-forming the abrasive grain layer powder and the foundation layer powder bodily to an arc shape, and taking out of the press-forming mold the abrasive grain layer and the foundation layer bodily formed by the press-forming mold, so as to form the green wheel chips each having the grinding surface, the both lateral surfaces, the forward end surface and the rearward end surface, and that the adhering step comprises adhering the respective baked wheel chips to the outer circumference of the core with a clearance between the rearward end surface of a wheel chip adjoining ahead in the rotational direction of the grinding wheel and the forward end surface of a wheel chip adjoining the wheel chip behind in the rotational direction of the grinding wheel.

The features in construction of the invention in a fourth aspect reside in that in the first aspect, the wheel chip forming step comprises performing a press-forming by bodily placing the foundation layer being a mixture of foundation particles and a bonding agent on an inner side of the abrasive grain layer being a mixture of superabrasive grains and a bonding agent so that a contact surface of the foundation layer which is to contact the core is formed to an arc shape whose arc is larger than the outer diameter of the core and so that a pair of lateral end surfaces are formed to cross the contact surface at right angles at both sides of the arc shape contact surface and to be parallel to each other, and taking out of the press-forming mold the abrasive grain layer and the foundation layer made bodily by the press-forming, to form the green wheel chips, that the adhering step comprises adhering the plurality of baked wheel chips to the outer circumference of the core so that facing lateral surfaces of adjoining wheel chips provide a clearance therebetween to form inner side walls of an oblique groove and so that the lateral end surfaces are inclined relative to the wheel circumferential direction, and that after the adhering step, there is further provided an eliminating step of eliminating, by machining, portions which are of the baked wheel chips having been adhered to the core and which project beyond the axial width of the core.

The features in construction of the invention in a fifth aspect reside in a grinding wheel in which a plurality of wheel chips each composed of an abrasive grain layer containing superabrasive grains and a foundation layer are adhered to a core attached to a wheel spindle carried by a wheel head of a grinding machine to be drivingly rotatable about a rotational axis and in which a grinding surface formed on the abrasive grain layers grinds a workpiece, drivingly rotatably supported by a workpiece support device of the grinding machine, in contact at a grinding point, wherein the wheel chip has both ends in a wheel circumferential direction inclined relative to the wheel circumferential direction, wherein the foundation layer has a protruding portion formed to protrude from the abrasive grain layer in the wheel circumferential direction, and wherein the plurality of wheel chips are adhered to the core so that the protruding portion contacts the foundation layer of an adjoining wheel chip to form an oblique groove between adjoining abrasive grain layers.

The features in construction of the invention reside in that in the fifth aspect, the wheel chip has the protruding portion which is formed by protruding at least one end in the wheel circumferential direction of the foundation layer from the abrasive grain layer stepwise in the wheel circumferential direction and that each wheel chip is adhered to the core with the protruding portion contacting the foundation layer of an adjoining wheel chip.

The features in construction of the invention reside in that in the fifth aspect, the protruding portions are formed to protrude a small diameter side of the foundation layer from the abrasive grain layer in the wheel circumferential direction by press-forming the wheel chip to make both end surfaces thereof in the wheel circumferential direction parallel to each other.

The features in construction of the invention reside in that in the fifth aspect, the wheel chip has the protruding portion which is formed by inclining at least one end surface in the wheel circumferential direction to protrude longer on a smaller diameter side and that each wheel chip is adhered to the core with the protruding portion contacting the foundation layer of an adjoining wheel chip.

Effects of the Invention

With the invention in the first aspect, since the wheel chips are adhered to the core so that the oblique groove inclined relative to the wheel circumferential direction is formed between the abrasive grain layers of adjoining wheel chips, it is no longer required to cut oblique grooves by machining on the grinding surface of the baked wheel chips which are difficult to machine. Thus, it does not occur that the retention force of the superabrasive gains on the grinding surface is deteriorated by machining, and the manufacturing can be done in a short period of time and at a low cost.

With the invention in the second aspect, baked is the wheel chip in which both ends in the wheel circumferential direction are inclined relative to the wheel circumferential direction and which has the protruding portion formed by protruding the foundation layer from the abrasive grain layer in the wheel circumferential direction. The plurality of wheel chips are adhered to the core so that the oblique groove is formed by contacting the protruding portion of the wheel chip with the foundation layer of the adjoining wheel chip. Thus, since the oblique grooves are not cut by machining on the grinding surface of the baked wheel chips having been adhered to the core, it does not occur that the retention force of the superabrasive grains is lowered by machining.

With the invention in the third aspect, the wheel chip which in addition to the arc-shape grinding surface, has the oblique end surfaces configuring inner side walls of the oblique groove when adhered to the core is formed by press-forming. Thus, only by adhering the adjoining wheel chips to the core with a clearance provided between the facing end surfaces, the obliquely grooved grinding wheel can be formed easily. Since in this way, the oblique grooves are not cut by machining on the grinding surface of the baked wheel chips having been adhered to the core and being difficult to machine, it becomes possible to provide an obliquely grooved grinding wheel with which it does not occur that the retention force of the superabrasive grains is lowered by machining, and which can be manufactured in a short period of time and at a low cost.

With the invention in the fourth aspect, it is possible to press-form the wheel chips easily without using a special press-forming mold. Further, by making the contact surface of the wheel chip as an arc surface which is greater than the outer diameter of the core, the wheel chip can be adhered to the outer circumference of the core with the lateral end surfaces inclined relative to the wheel circumferential direction and with the clearance suppressed to be small which is generated between the contact surface and the outer circumferential surface of the core. Although the projecting portions which of the adhered wheel chips, project out in the width direction of the core are eliminated by machining, the oblique grooves provided on the grinding surface of the wheel chips are not cut by machining, and therefore, it does not occur that the machining lowers the retention force of the superabrasive grains on the grinding surface which is mainly used during grinding operations.

With the invention in the fifth aspect, the wheel chip has both ends in the wheel circumferential direction inclined relative to the wheel circumferential direction, and the foundation layer has the protruding portion formed to protrude from the abrasive grain layer in the wheel circumferential direction. The plurality of wheel chips are adhered to the core so that the protruding portion of the wheel chip contacts the foundation layer of an adjoining wheel chip to form an oblique groove between the adjoining abrasive grain layers. Thus, since machining to cut the oblique grooves is not carried out on the difficult-to-machine grinding surface of the baked wheel chips having been adhered to the core, it becomes possible to provide an obliquely grooved grinding wheel with which it does not occur that the retention force of the superabrasive grains is lowered by machining, and which can be manufactured in a short period of time and at a low cost.

With the invention in the sixth aspect, since the plurality of wheel chips are adhered to the core in the state that the foundation layer of each wheel chip contacts the foundation layer of an adjoining wheel chip at the protruding portion which is formed at least one end in the wheel circumferential direction to protrude from the abrasive grain layer stepwise in the wheel circumferential direction, it becomes possible to provide a grinding wheel on which an oblique groove being rectangular in cross-section and being of a desired dimension can be formed easily between adjoining abrasive grain layers.

With the invention in the seventh aspect, since the protruding portion is formed to protrude a small diameter side of the foundation layer from the abrasive grain layer 12 in the wheel circumferential direction by press-forming each wheel chip to make the opposite end surfaces in the wheel circumferential direction parallel to each other, it becomes possible to form the wheel chips each with the protruding portion in a usual manner, easily and at a low cost by using the outer mold whose both lateral surfaces are parallel.

With the invention in the eighth aspect, since the plurality of wheel chips are adhered to the core in the state that the protruding portion which is formed to be inclined so that at least one end surface in the wheel circumferential direction of each wheel chip protrudes longer in the wheel circumferential direction on a smaller diameter side contacts the foundation layer of an adjoining wheel chip, it becomes possible to provide a grinding wheel which is easy to form a plurality of oblique grooves between adjoining abrasive grain layers at a low cost.

BRIEF DESCRIPTION OF THE DRAWINGS

FIGS. 27(*a*)-27(*d*) are views showing the steps of manufacturing wheel chips in the third embodiment.

FIG. 28 is a view showing a wheel chip manufactured in a manufacturing method in the third embodiment.

DESCRIPTION OF REFERENCE SYMBOLS

10 . . . grinding wheel, 11 . . . wheel chips, 12 . . . abrasive grain layer, 13 . . . foundation layer, 14 . . . core, 15 . . . grinding surface, 16 . . . superabrasive grains, 17 . . . vitrified bond, 20 . . . oblique grooves, 21, 22 . . . lateral surfaces, 23 . . . protruding portions, 24, 25 . . . opposite ends in wheel circumferential direction, 30 . . . grinding machine, 31 . . . wheel head, 32 . . . wheel spindle, 33 . . . workpiece support device, 35 . . . coolant nozzle, 40 . . . outer mold, 41, 42 . . . end walls, 41*s* . . . stepped portion, 43 . . . lower mold, 45 . . . abrasive grain layer powder, 46 . . . first upper mold, 50 . . . foundation layer powder, 51 . . . second upper mold, 60 . . . press-forming mold, 62 . . . grinding surface forming wall, 64 . . . lower mold, 66, 72 . . . lateral surface forming walls, 68, 74 . . . end surface forming walls, 78 . . . upper mold, 91 . . . forming mold, 98 . . . arc surface, 100 . . . lateral end surfaces, 102 . . . projecting portions, b . . . clearance (groove width), P . . . grinding point, W . . . Workpiece, $\alpha$ . . . inclination angle.

PREFERRED EMBODIMENTS FOR PRACTICING THE INVENTION

Figure 1:
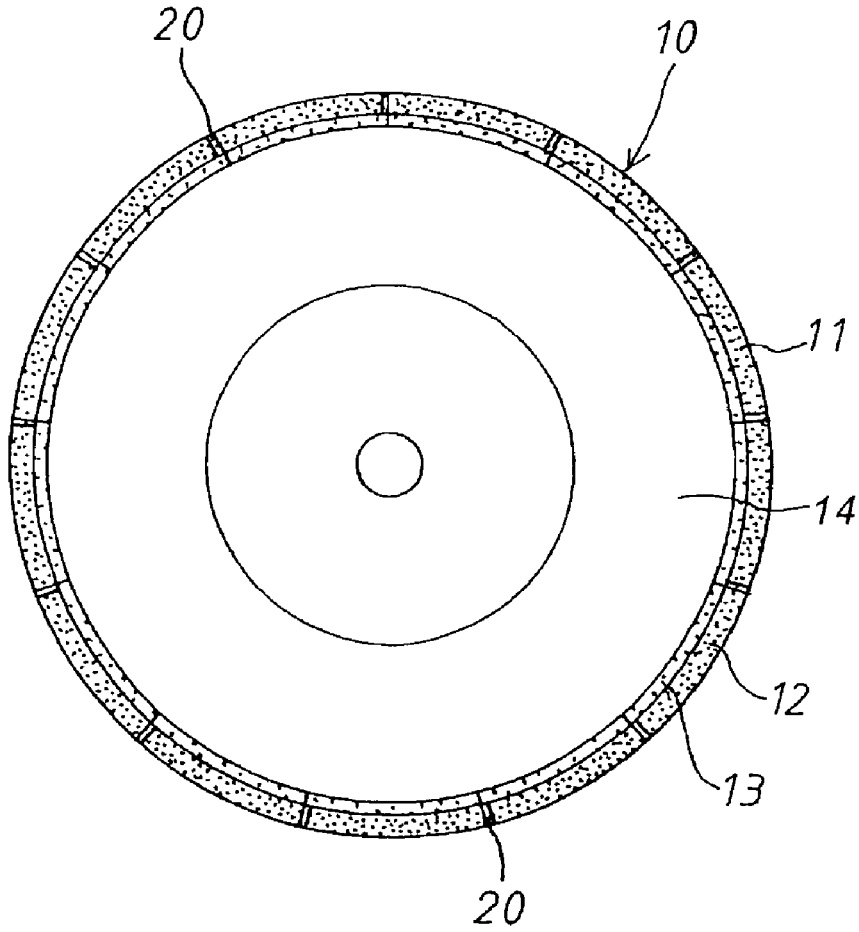
FIG. 1 is a general view of a grinding wheel composed of segmented wheel chips, showing a first embodiment according to the present invention.

Hereafter, a first embodiment according to the present invention will be described with reference to the drawings. FIG. 1 shows a grinding wheel 10 including segmented wheel chips 11. The grinding wheel 10 is configured so that a plurality of arc-shaped wheel chips 11 each composed of an abrasive grain layer 12 and a foundation layer 13 are arranged on an outer circumferential surface of a disc-like core 14 made of a metal such as iron, aluminum or the like, a resin or the like and are adhered by an adhesive to the core 14 at bottom surfaces of the foundation layers 13.

Figure 2:
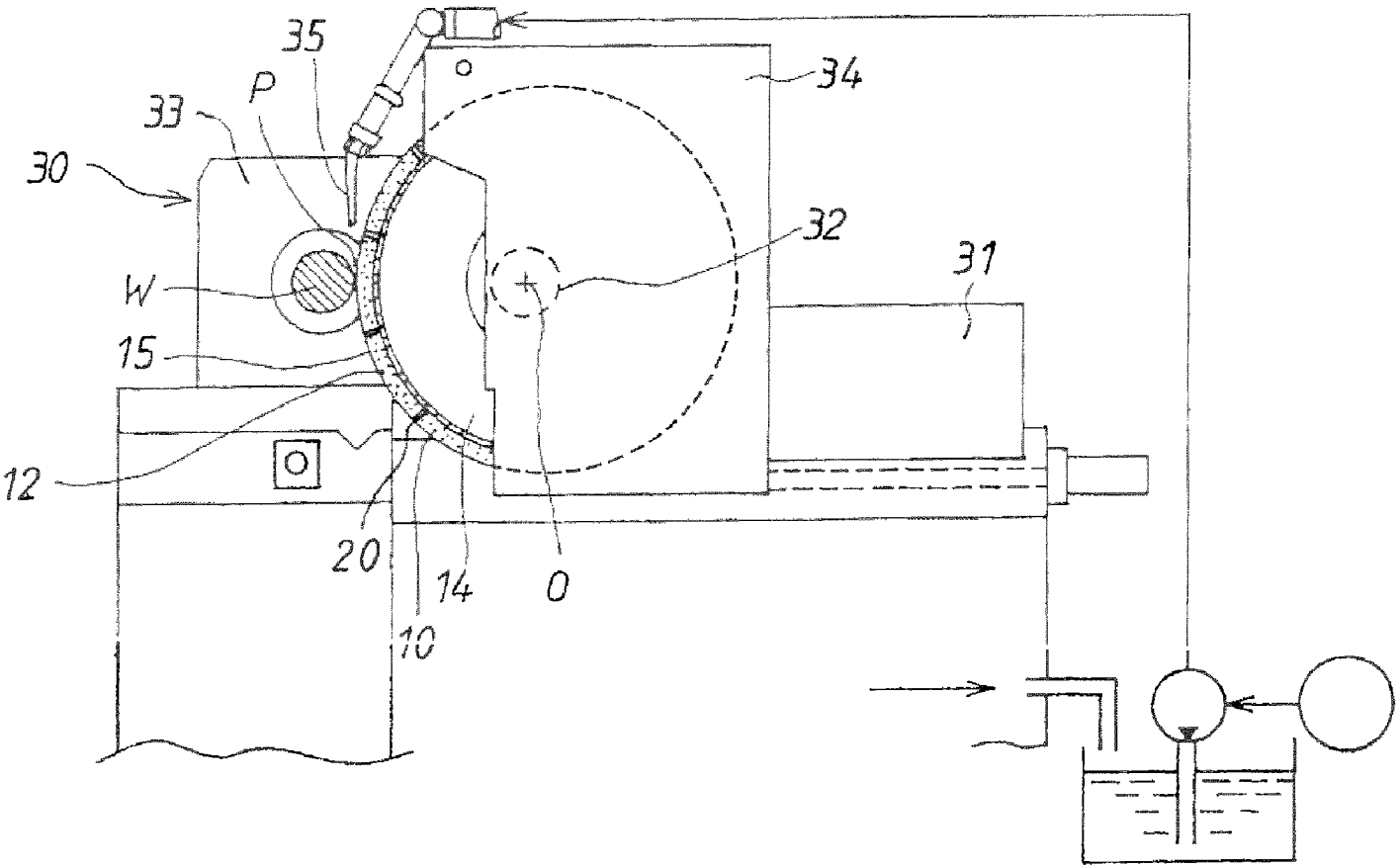
FIG. 2 is a view showing the state that a workpiece is ground in a grinding machine mounting an obliquely grooved grinding wheel.

The grinding wheel 10 is attached at the core 14 to a wheel spindle 32 which is carried by a wheel head 31 of a grinding machine 30 shown in FIG. 2, to be drivingly rotatable about an axis O. A workpiece W is drivingly rotatably supported by a workpiece support device 33 of the grinding machine 30. The advance movement of the wheel head 31 brings a grinding surface 15 formed on the abrasive grain layers 12 of the grinding wheel 10, into contact with the workpiece W at a grinding point P, so that the outer surface of the workpiece W is ground.

Figure 3:
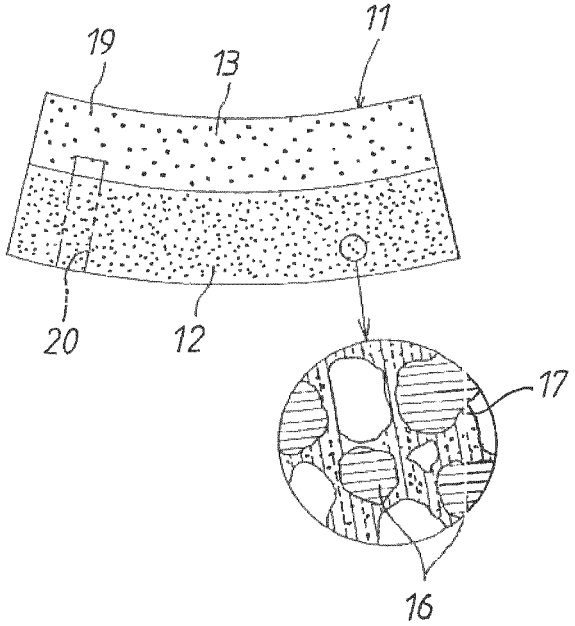
FIG. 3 is a view showing a wheel chip.

In each wheel chip 11, the abrasive grain layer 12 in which superabrasive gains are bonded by a vitrified bond is formed on the outer circumferential side, and the foundation layer 13 is placed on the inner side of the abrasive grain layer 12 to be formed bodily therewith. FIG. 3 shows the arc-shaped wheel chip 11, the abrasive grain layer 12 of which is configured by bonding with the vitrified bond 17 the superabrasive grains 16 such as CBN, diamond or the like to the depth of 3 to 7 mm. It may be the case that particles such as aluminum oxide ($Al_2O_3$) or the like which replace those of superabrasive grains are mixed as aggregate into the abrasive grain layer 12 for adjustment of concentration. Further, the foundation layer 13 is configured by bonding foundation particles 19 with the vitrified bond 17 to the depth of 2 to 4 mm. Because with the use of the vitrified bond 17, the property being porous improves the capability of discharging grinding chips thereby to enhance the sharpness, the grinding can be performed at an excellent accuracy of surface roughness and in a little quantity of the grinding wheel wear. However, as bonding agent, a resin bond, a metal bond or the like may be used instead of the vitrified bond 17.

Figure 4:
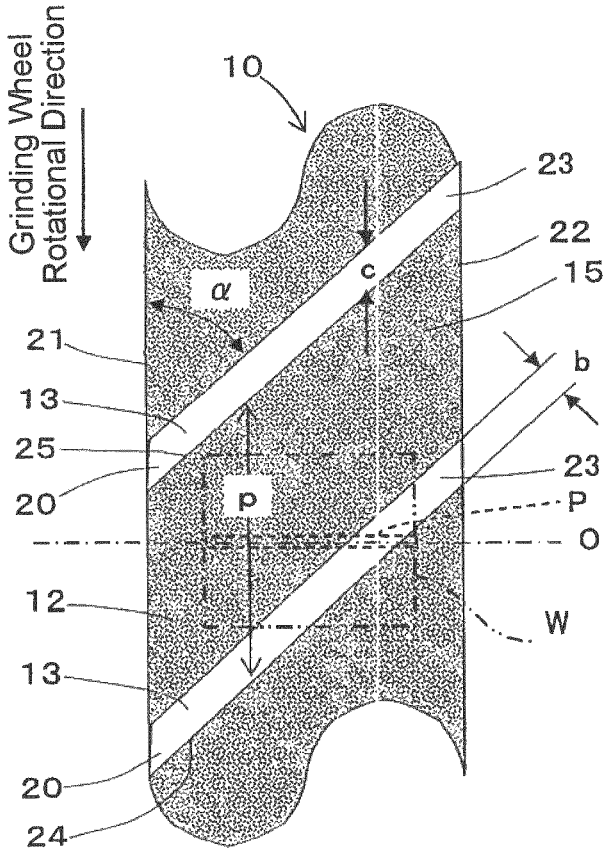
FIG. 4 is a view showing the state in which a plurality of oblique grooves are formed on a grinding surface of the grinding wheel in such an arrangement that at least one oblique groove crosses a grinding point at all times.
Figure 5:
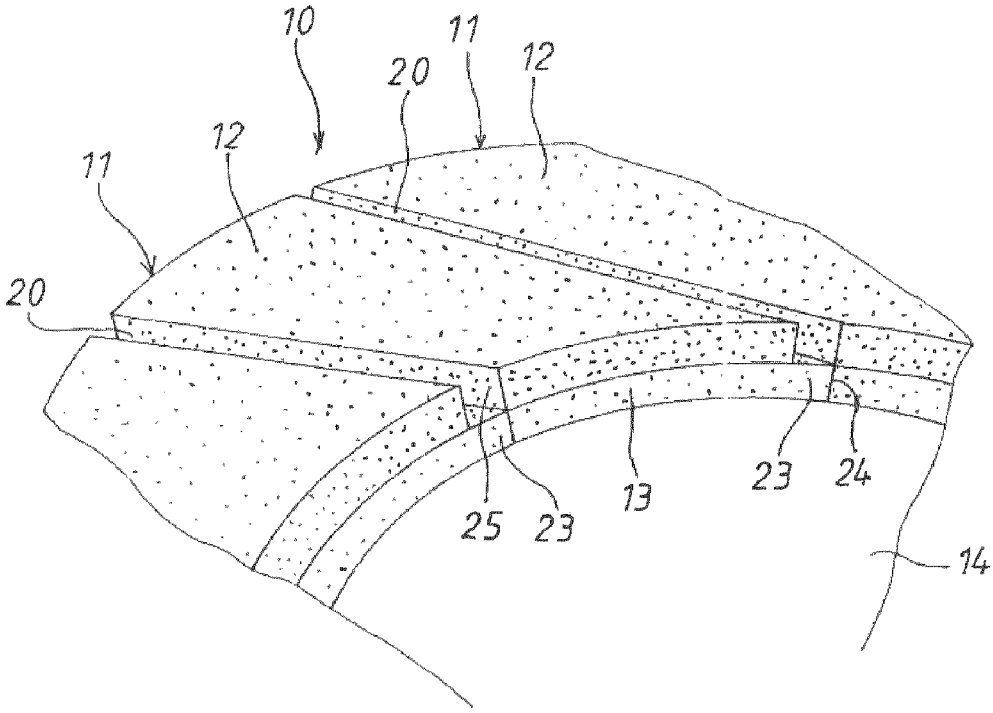
FIG. 5 is a perspective view showing the state that wheel chips are adhered to a core.

As shown in FIGS. 4 and 5, a plurality of oblique grooves 20 of the width b inclined relative to the wheel circumferential direction are provided on the grinding surface 15 of the grinding wheel 10 in such an arrangement that at least one oblique groove 20 vertically crosses the grinding point P independently of the rotational phase of the grinding wheel 10. Because the oblique groove 20 crosses the grinding point P at all times in this way, a dynamic pressure which the coolant supplied to the grinding point P generates between the grinding surface 15 and the workpiece W is released from both of an upper side and a lower side of the grinding point P. Thus, it does not occur that the workpiece W is displaced in a direction away from the grinding wheel 10 to result in a large dimension of the workpiece, and improvement is made in grinding accuracy and particularly, in roundness. Unless at least one oblique groove 20 crosses the grinding point P at all times, there would occurs a situation that the oblique groove 20 opens only on the upper side of the grinding point P, in which case the dynamic pressure would not be able to be released on the lower side of the grinding point P. Likewise, in another situation that the oblique groove 20 opens only on the lower side of the grinding point P, the dynamic pressure in the coolant would not be able to be released on the upper side of the grinding point P.

Each wheel chip 11 has the same width as the width of the outer circumferential surface of the core 14 and is arcuately curved to make the inner circumferential surface of the foundation layer 13 equal in curvature to the outer circumferential surface of the core 14. The opposite ends 24, 25 in the wheel circumferential direction of the wheel chip 11 are inclined by an inclination angle $\alpha$ relative to the wheel circumferential direction, and the foundation layer 13 has a protruding portion 23 formed by being protruded by a predetermined length c from the abrasive grain layer 12 in the wheel circumferential direction. When the plurality of wheel chips 11 are adhered to the core 14 with the protruding portion 23 of each wheel chip 11 contacting the foundation layer 13 of an adjoining wheel chip 11, an oblique groove 20 is formed between the abrasive grain layers 12 of the adjoining wheel chips 11, so that it can be realized to make at least one oblique groove 20 cross the grinding point P independently of the rotational phase of the grinding wheel 10.

Described hereunder are the conditions for easily making the oblique grooves 20 which effectively prevent the generation of a dynamic pressure in the coolant supplied to the grinding point P and which can secure high grinding accuracy and a long wheel life. It is desirable that at least one, preferably two or more oblique grooves 20 are made to cross the grinding point P within the width of the workpiece W, that is, within the axial length of the grinding point P independently of the rotational phase of the grinding wheel 10. A groove circumferential width c (equal to the predetermined length c by which the protruding portion 23 protrudes in the wheel circumferential direction) being the width of the oblique groove 20 in the wheel circumferential direction is desired to be short for the reason that the interval of the superabrasive grains 16 exposed to the grinding surface 15 is widened by the groove circumferential width c. The number of the grooves would be better in light of decreasing the number of the wheel chips 11. A narrow interval of the oblique grooves 20 would make the circumferential length of the wheel chips 11 short and would cause the strength of the wheel chips 11 to be weakened, and therefore, the pitch in the wheel circumferential direction of the oblique grooves 20 is desired to be long. The total area of the oblique grooves 20, if were chosen to be too large, would cause an decrease in the number of the superabrasive grains 16 participating in grinding, thereby resulting in an increase in the wheel wear amount, and therefore, should not be set to too large.

Description will be made hereunder regarding a method of determining, with these conditions taken into consideration, the number n of the oblique grooves 20 and the inclination angle $\alpha$ which are appropriate in the case that for example, a plunge-cut grinding is carried out on a workpiece W of 15 mm in width with a grinding wheel 10 of 350 mm in outer diameter. The inclination angle $\alpha$ is the angle which the oblique grooves 20 make with the lateral surface 21 of the abrasive grain layers 12, that is, with respect to the wheel circumferential direction, and the axial length of the grinding point P is 15 mm equal to the width of the workpiece W.

Figure 6:
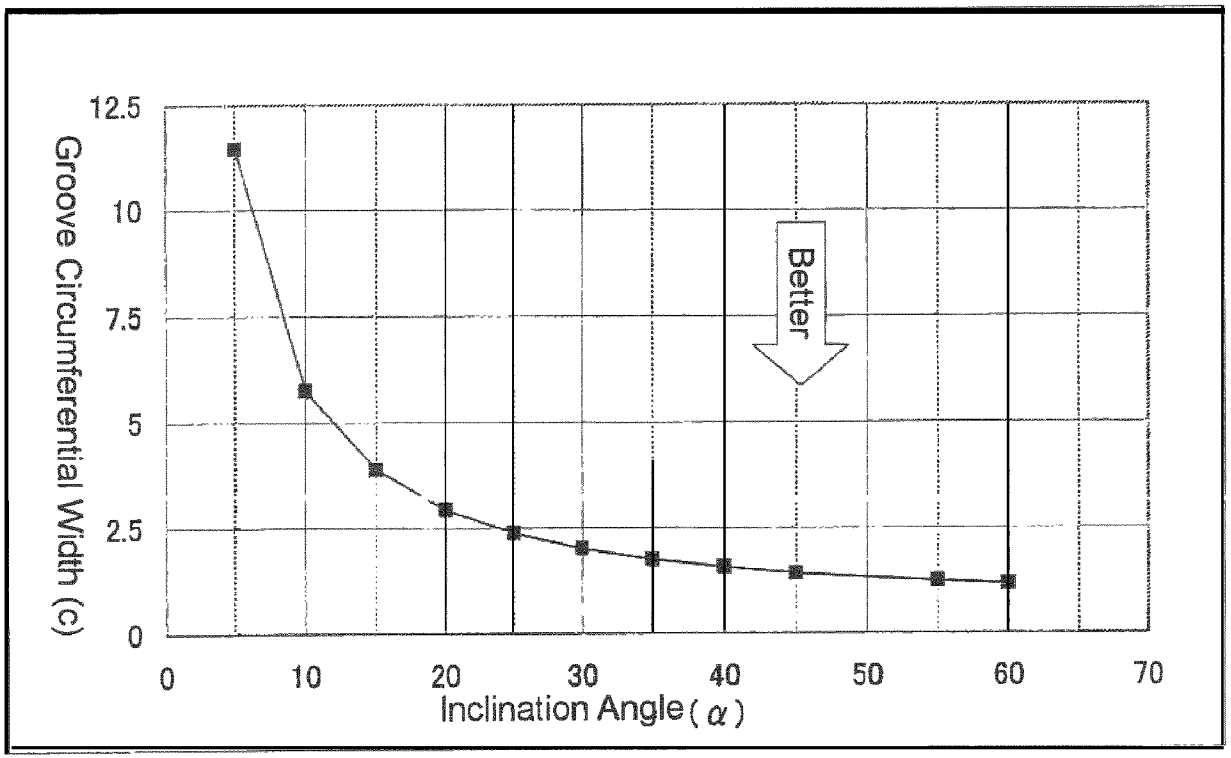
FIG. 6 is a graph showing the relation between groove circumferential width and inclination angle of the oblique grooves.

Taking account of ease in forming the protruding portion 23 and for the purpose of making short the groove circumferential width c being the length in the wheel circumferential direction of the oblique groove 20, the width b in the groove normal direction of the oblique groove 20 is desired to be set as 1 mm or so. The relation between the groove circumferential width c and the inclination angle $\alpha$ of the oblique groove 20 is represented in FIG. 6. Where the inclination angle $\alpha$ is set to be larger than 15 degrees or so, the groove circumferential width c becomes narrow, so that the stretch of the interval between the superabrasive grains 16 which stretch is made by the oblique groove 20 can be suppressed to be small.

Figure 7:
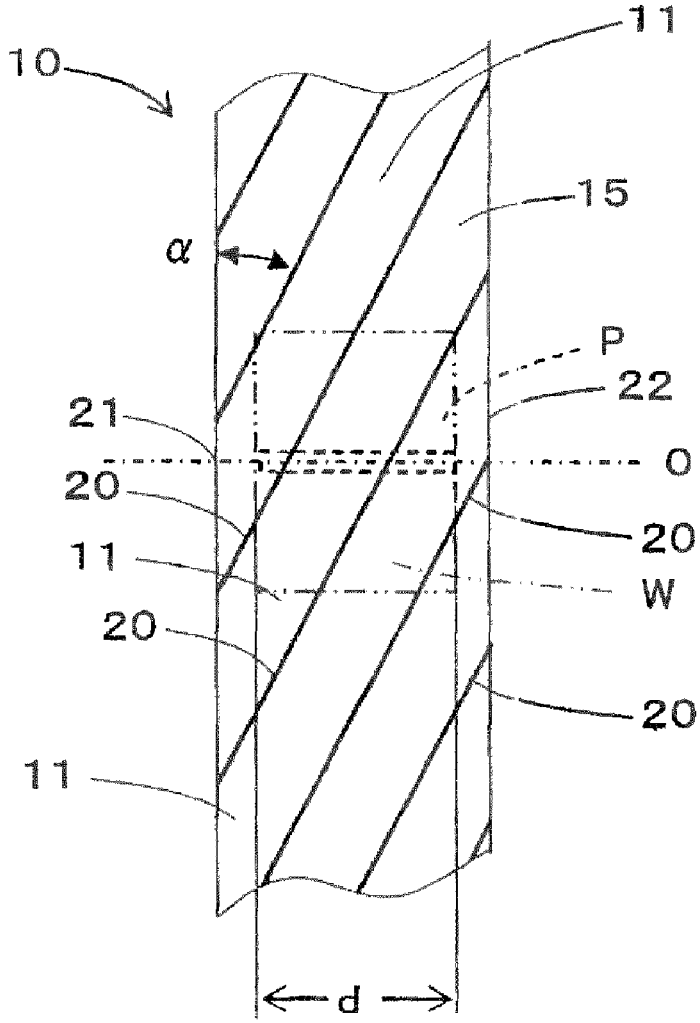
FIG. 7 is a view showing the state that the oblique grooves are provided to make two oblique grooves cross a grinding point, having the same axial length as the width of a workpiece, at all times.
Figure 8:
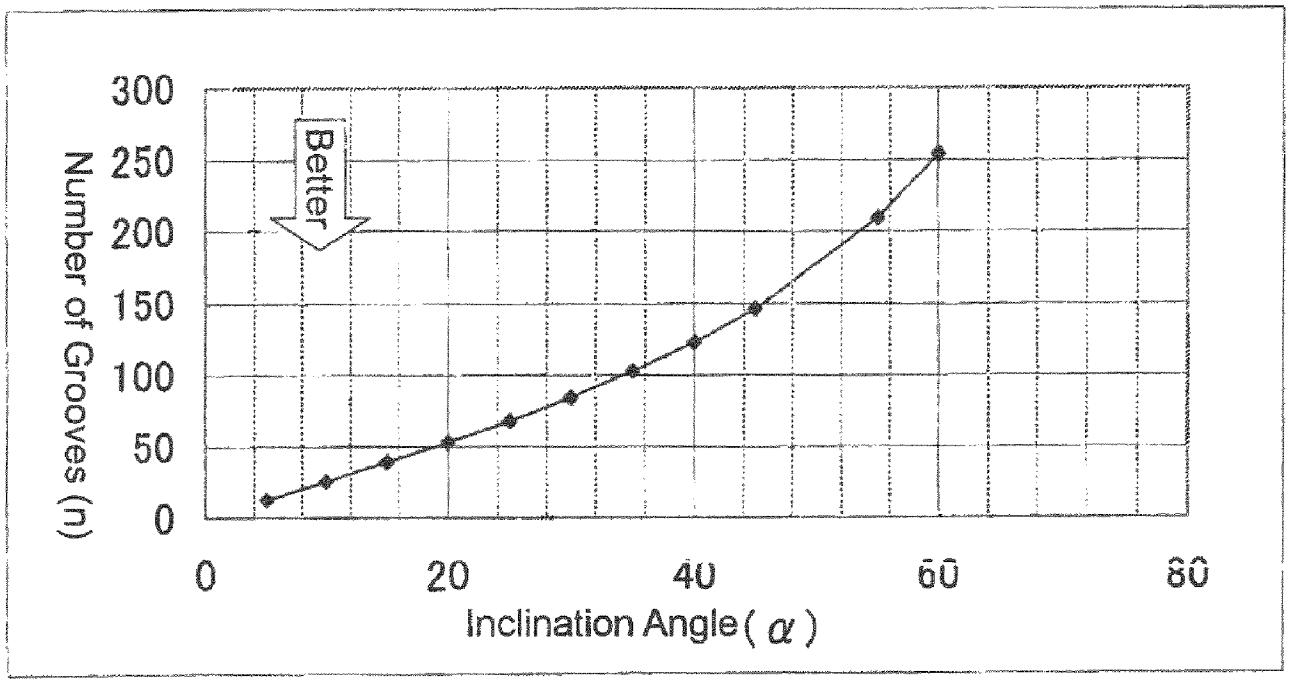
FIG. 8 is a graph showing the relation between inclination angle of the oblique grooves and the number thereof.
Figure 9:
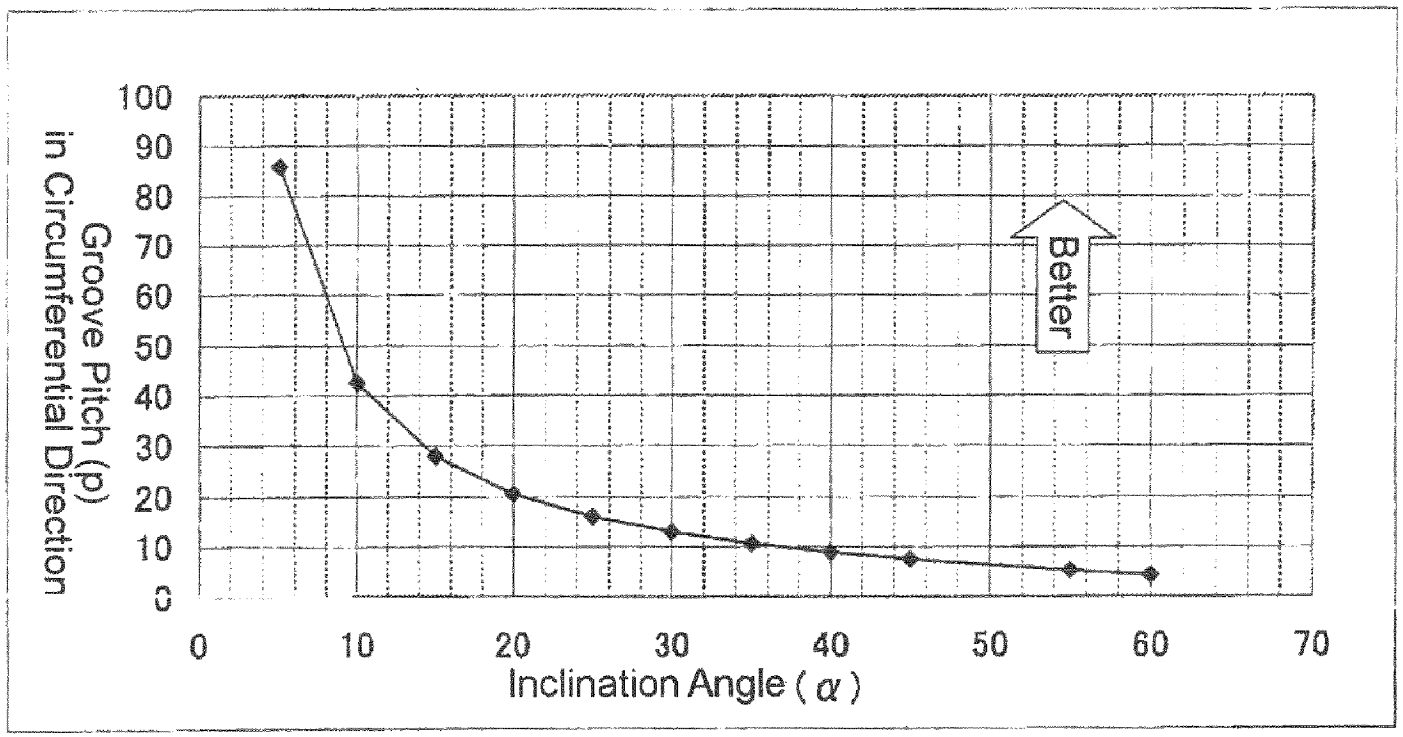
FIG. 9 is a graph showing the relation between inclination angle of the oblique grooves and pitch in the wheel circumferential direction.
Figure 10:
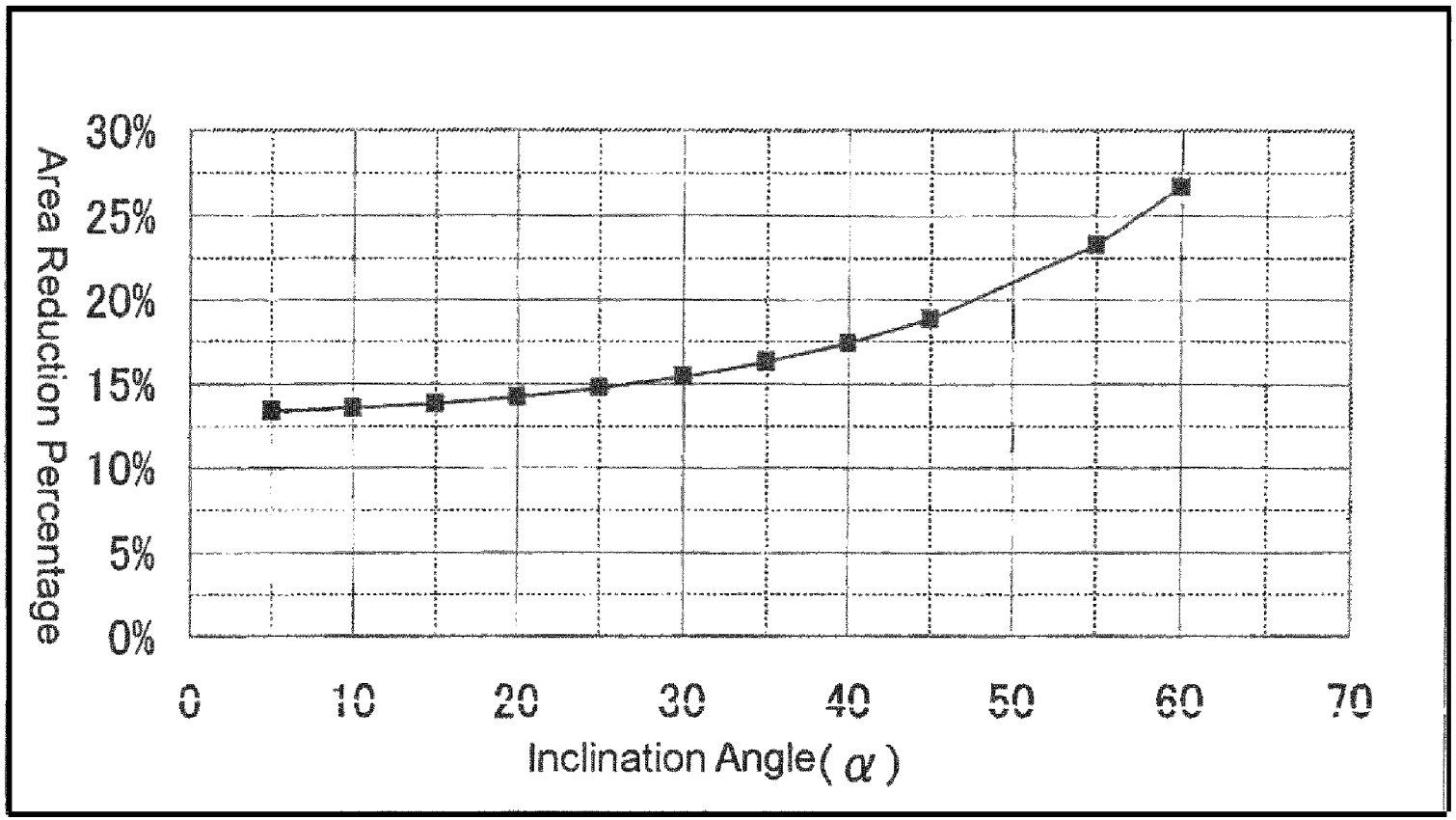
FIG. 10 is a graph showing the relation between inclination angle of the oblique grooves and percentage of reduction in the area of a grinding surface.
Figure 11A:
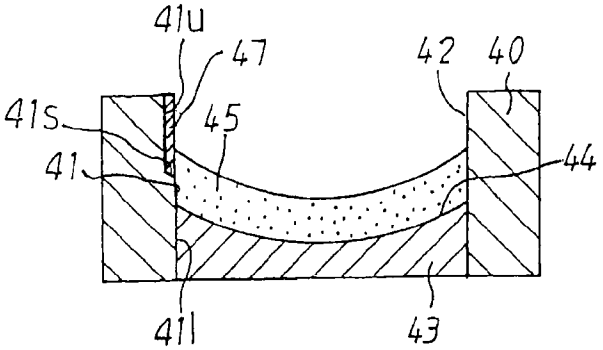
FIGS. 11(*a*)-11(*d*) are views showing the states of press-forming an obliquely grooved wheel chip.
Figure 11B:
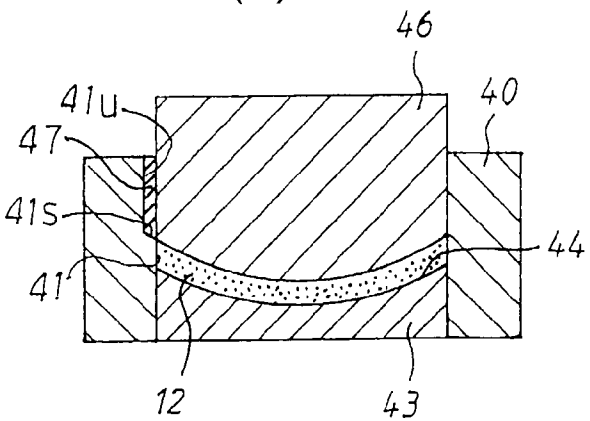
Figure 11C:
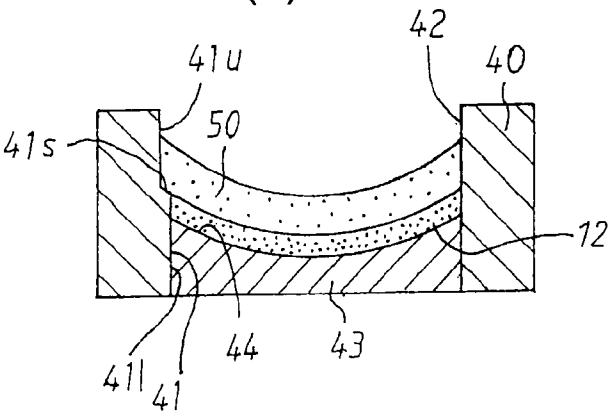
Figure 11D:
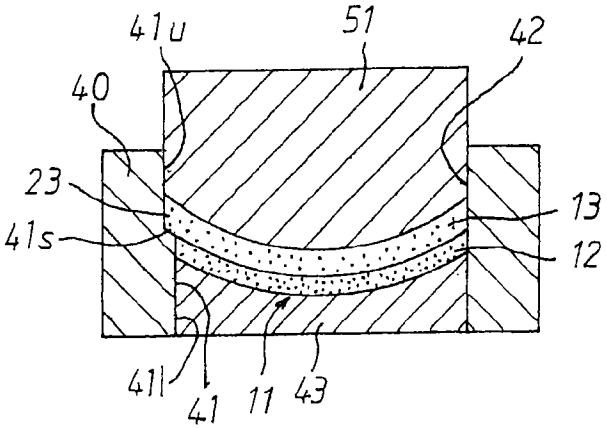

As shown in FIG. 7, where within a width d for the outer grinding surface 15 (e.g., 350 mm in outer diameter) of the grinding wheel 10 to contact the workpiece W (e.g., 15 mm in width), the oblique grooves 20 of e.g., two in number are made to cross the grinding point P with the same axial length as the width of the workpiece W independently of the rotational phase of the grinding wheel 10, the relation between the inclination angle α and the number n of the oblique grooves 20 is represented as shown in FIG. 8, the relation between the inclination angle α and the pitch p in the wheel circumferential direction of the oblique grooves 20 is represented as shown in FIG. 9, and the relation between the inclination angle α and the reduction percentage at which the area of the grinding surface 15 is reduced by the oblique grooves 20 is represented as shown in FIG. 10. As apparent from FIG. 9, where the inclination angle α is made to be smaller than 15 degrees or so, the pitch p in the wheel circumferential direction of the oblique grooves 20 becomes sufficiently wide, so that the circumferential length of the wheel chip 11 becomes sufficiently long. Further, as shown in FIG. 10, where the inclination angle α is made to be smaller than 15 degrees or so, the reduction percentage at which the area of the grinding surface 15 is reduced by the oblique grooves 20 can be suppressed to become small. Further, as shown in FIG. 8, where the inclination angle α is set to 15 degrees or so, the number n of the oblique grooves 20 can be decreased. With these facts taken into account, it is preferable to set the inclination angle α to a value approximate to 15 degrees.

In this way, where the workpiece W of 15 mm in width is ground with the grinding wheel 10 of 350 mm in outer diameter in a plunge-cut mode, the specifications of the oblique grooves 20 are determined to make two oblique grooves 20 cross the grinding point P within the width of the workpiece W, that is, within the axial length of the grinding point P independently of the rotational phase of the grinding wheel 10, and one example of the specifications so determined is 1 mm in the groove width b, 15 degrees in the inclination angle α, 39 in the number n, and about 28.1 mm in the circumferential pitch p.

In order to provide the oblique groove 20 of the aforementioned specifications between adjoining wheel chips 11, each wheel chip 11 has the opposite ends 24, 25 in the wheel circumferential direction inclined 15 degrees relative to the wheel circumferential direction, is 28.1 mm in the circumferential length, is provided at the foundation layer 13 with the protruding portion 23 protruding from the abrasive grain layer 12 in the wheel circumferential direction, has the width of, e.g., 30 mm which is double the width of the workpiece W, and takes the shape of being arcuately curved to make the inner circumferential surface of the foundation layer 13 equal in curvature to the outer circumferential surface of the core 14. In order to set the groove width b to 1 mm, the protruding portion 23 protrudes 1 mm from the end surface of the abrasive grain layer 12 perpendicularly of the end surface.

Figure 12:
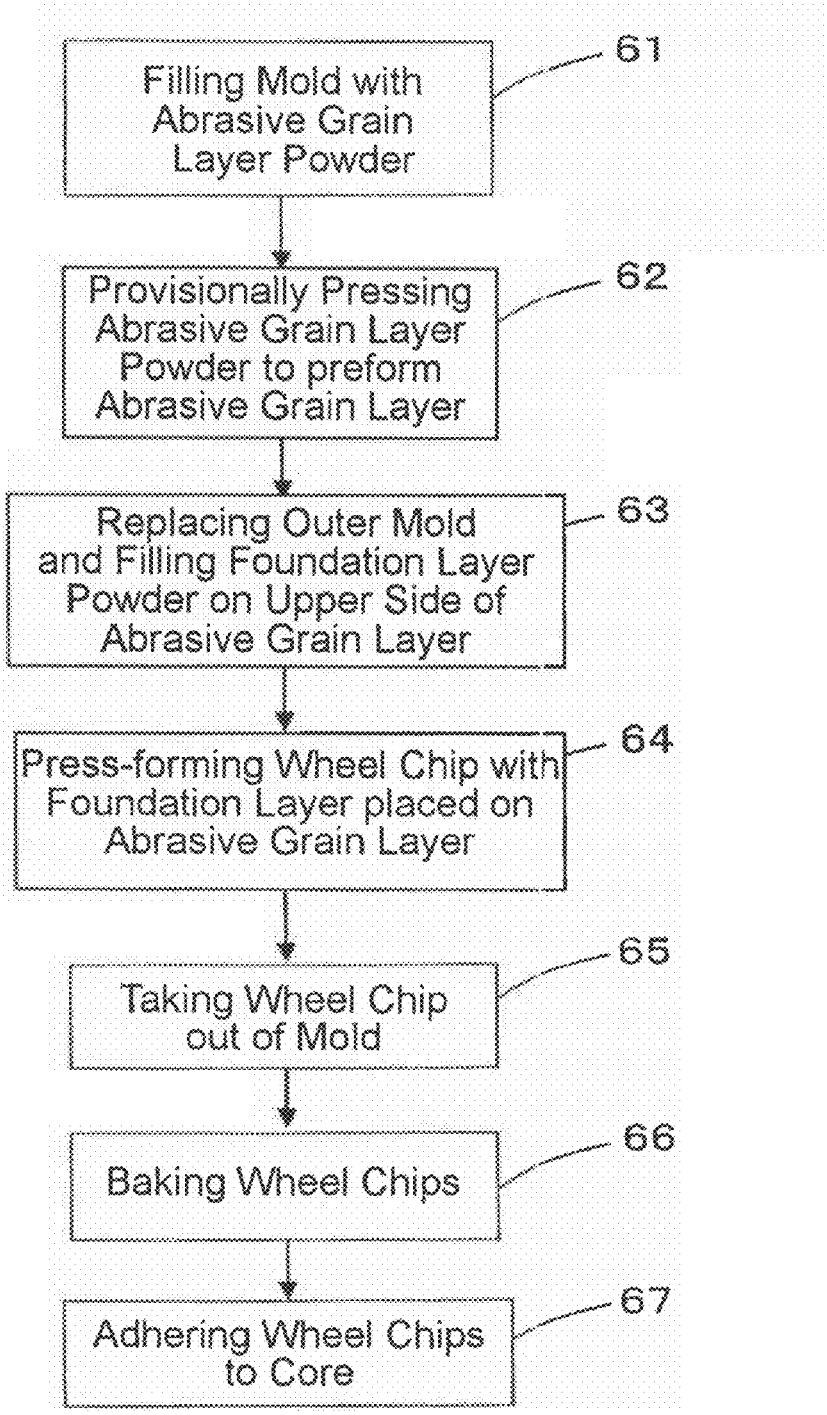
FIG. 12 is a diagram showing the steps of manufacturing the obliquely grooved grinding wheel.

Next, a method of manufacturing the wheel chips 11 like this will be described with reference to FIGS. 11 and 12. As shown in FIG. 11(*a*), a lower mold 43 is fitted in an inside bottom portion of a rhombic outer mold 40 which has lateral walls corresponding to both parallel lateral surfaces 21, 22 of the wheel chip 11 and end walls 41, 42 inclined by the inclination angle α relative to the wheel circumferential direction and corresponding to the opposite ends 24, 25, and an arc-shape concave surface 44 corresponding to the arc surface of the wheel chip 11 for forming the outer diameter of the grinding wheel 10 is formed on an upper surface of the lower mold 43. One end wall 41 is provided with a step portion 41*s* and a concave wall 41*u* for forming the protruding portion 23, and a detachable block 47 is fitted in the step portion 41*s* and the concave wall 41*u*. The surface of the block 47 so fitted and the interior surface of the one end wall 41 are formed to share a common flat surface. Abrasive grain layer powder 45 being a mixture of superabrasive grains 16, a vitrified bond 17, aggregate (not shown) and the like which constitute the abrasive grain layer 12 is filled on the lower mold 43, and leveling is done to make the abrasive grain layer powder 45 uniform in thickness (step 61 in FIG. 12). In this state, as shown in FIG. 11(*b*), a pressing mold being a first upper mold 46 is moved down along the interior surface of the outer mold 40, whereby the abrasive grain layer powder 45 is provisionally pressed to preform the abrasive grain layer 12 to an arc shape (step 62).

After this, the block 47 is taken out of the step portion 41*s* and the concave wall 41*u* of the end wall 41, whereby as shown in FIG. 11(*c*), the step portion 41*s* and the concave wall 41*u* come to appear on the one end wall 41 of the outer mold 40 at a position facing the edge of the inner circumferential surface of the abrasive grain layer 12 having been preformed on the lower mold 43. An end wall 41*l* below the step portion 41*s* of the one end wall 41, the other end wall 42 and the both lateral walls surround the lower mold 43 and the preformed abrasive grain layer 12, and the concave wall 41*u* above the step portion 41*s* recedes outside by the width b in the groove normal direction of the oblique groove 20 from the end wall 41*l* below the step portion 41*s*.

The foundation layer powder 50 including foundation particles 19 is filled on the upper side of the abrasive grain layer 12 press-formed provisionally and is leveled so that the foundation layer powder 50 becomes uniform in thickness (step 63). In the state, as shown in FIG. 11(*d*), a second upper mold 51 which has an arc surface formed at an end to be the same in diameter as the core 14 is lowered along the interior surface of the outer mold 40 to press the foundation layer powder 50 and the abrasive grain layer powder 45 at a time. Thus, the foundation layer 13 is bodily press-formed to be placed on the inner side of the abrasive grain layer 12, and the protruding portion 23 is formed at a portion which the foundation layer 13 protrudes from the abrasive grain layer 12 in the wheel circumferential direction, whereby the arc-shape wheel chip 11 is formed (step 64). Then, the second upper mold 51 is moved up, and the arc-shape wheel chip 11 is taken out of the outer mold 40 and the lower mold 43 (step 65). A plurality of green wheel chips 11 are manufactured in the same manner as described above.

Subsequently, the wheel chips 11 are baked in a furnace (step 66), whereby the manufacturing of the wheel chips 11 are completed. Thirty-nine wheel chips 11 so baked are adhered to the core 14 in such an arrangement that the oblique groove 20 is formed between adjoining wheel chips 11 by contacting the protruding portion 23 with the foundation layer 13 of an adjoining wheel chip 11 and that at least two oblique grooves 20 cross the grinding point P independently of the rotational phase of the grinding wheel 10 (step 67). Because the wheel chips 11 are not machined after the baking for the purpose of cutting the oblique grooves 20, it does not occur that the retention force of the superabrasive grains 16 is weakened by such machining.

Next, description will be made regarding the operation of the grinding wheel 10 manufactured by the obliquely grooved grinding wheel manufacturing method in the present embodiment. The grinding wheel 10 is drivingly rotated with the core 14 attached to the wheel spindle 32 which is rotatably supported by the wheel head 31 of the grinding machine 30 shown in FIG. 2, while the workpiece W is drivingly rotated with itself supported by the workpiece support device 33 composed of a work head and a foot stock. Coolant is supplied from a coolant nozzle 35 attached to a wheel cover 34, toward the grinding point P between the grinding wheel 10 and the workpiece W. The wheel head 31 is fed toward the workpiece W, whereby the workpiece W is ground with the grinding wheel 10. At this time, since at least two oblique grooves 20 inclined relative to the wheel circumferential direction cross the grinding point P at all times independently of the rotational phase of the grinding wheel 10, a dynamic pressure which the coolant supplied to the grinding point P generates between the grinding surface 15 and the workpiece W can be released from the upper and lower sides of the grinding point P. Accordingly, it does not take place that the workpiece W is displaced in a direction away from the grinding wheel 10 to make the dimension of the workpiece W large, and thus, it becomes possible to heighten the machining accuracy and particularly, the roundness.

Figure 13A:
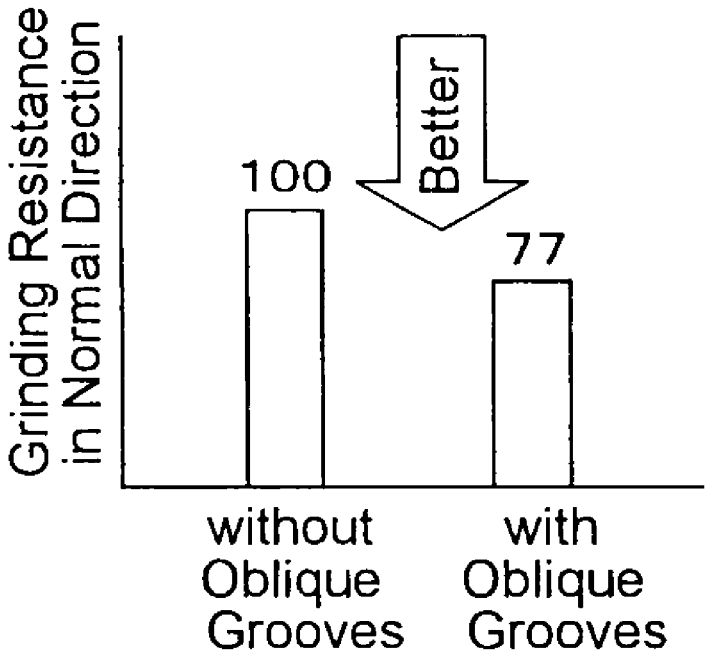
FIGS. 13(*a*) and 13(*b*) are graphs demonstrating the rates at which the obliquely grooved grinding wheel improves the grinding resistance in the normal direction and the profile accuracy.
Figure 13B:
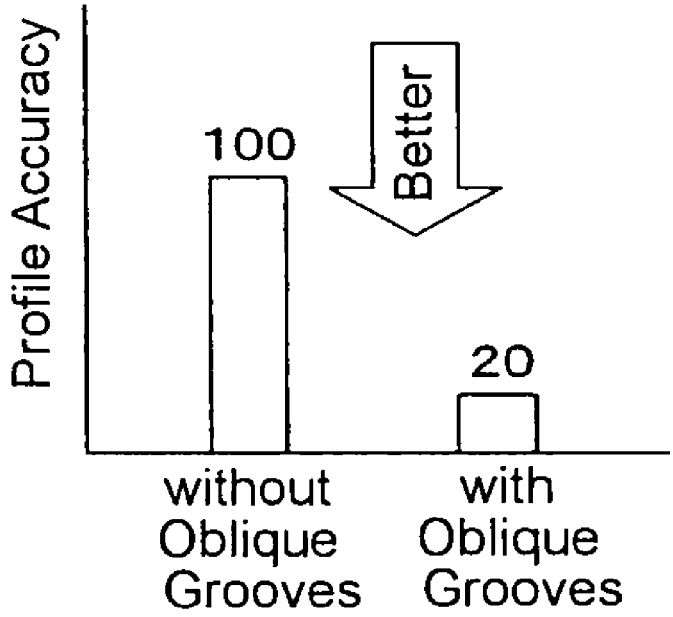

One example of the grinding operation using the obliquely groove grinding wheel 10 will be described in comparison with that using a grinding wheel with no oblique grooves thereon. For a comparative grinding operation, there was used a grinding wheel of 350 mm in outer diameter wherein the abrasive grain layers 12 were formed by bonding CBN abrasive grains of #120 in grain size with the vitrified bond 17 in the concentration of 150 and wherein the wheel chips 11 were formed by bodily placing the foundation layers 13 with no superabrasive grains contained therein, on the inner sides of the abrasive grain layers 12 and were adhered to the steel core 14. By the use of the grinding wheel with no oblique grooves thereon, hardened steel cams (workpieces W) of 15 mm in width were ground, in which case each of the grinding resistance in the normal direction and the profile accuracy in the grinding operation was determined as "100" being a reference for comparison. In one example of the grinding operation in the present embodiment, the obliquely grooved grinding wheel 10 was used wherein thirty-nine oblique grooves 20 each being 1 mm in the groove width b, 6 mm in the groove depth h and 15 degrees in the inclination angle α were grooved on the outer circumferential grinding surface 15 of the aforementioned grinding wheel. By the use of the obliquely grooved grinding wheel 10, cams of the same kind as above were ground, in which case the result was that the grinding resistance in the normal direction decreased to "77" and that the profile accuracy was improved to "20" (refer to FIGS. 13(*a*) and 13(*b*)).

Figure 14B:
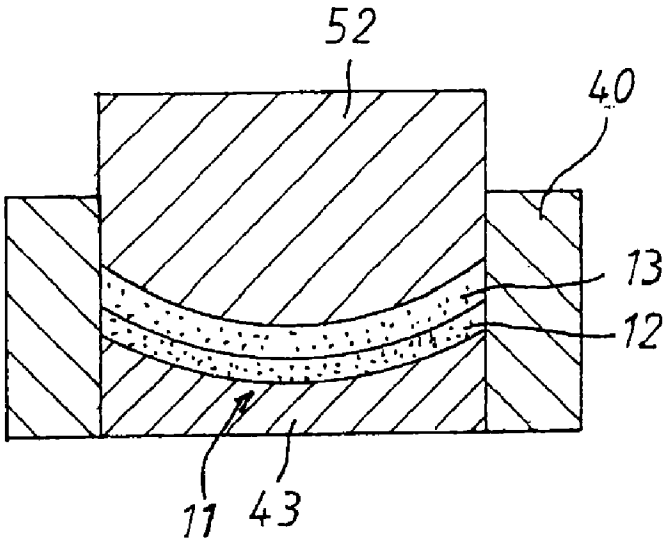
FIGS. 14(*a*) and 14(*b*) are views showing the states of press-forming a wheel chip in which opposite end surfaces in a wheel circumferential direction are parallel.
Figure 14A:
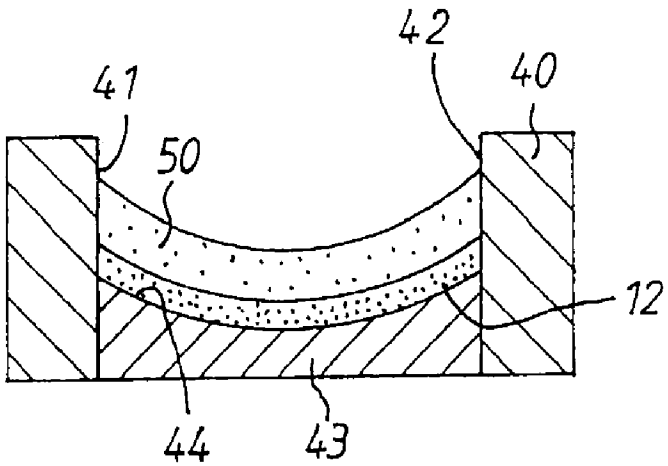

Although in the foregoing embodiment, the foundation layer 13 is press-formed by using the outer mold 40 having the step portion 41*s* and the concave wall 41*u* formed thereon, the outer mold 40 does not need to have the step portion 41*s* and the concave wall 41*u* formed thereon. That is, after the abrasive grain layer powder 45 is provisionally pressed at step 62 shown in FIG. 11(*b*) to provisionally form the abrasive grain layer 12 to an arc shape by moving the pressing mold being the first upper mold 46 down along the interior of the outer mold 40, the first upper mold 46 is moved up, the foundation layer powder 50 including the foundation particles 19 is filled on the upper side of the provisionally press-formed abrasive grain layer 12, and the foundation layer power 50 is leveled to become uniform in thickness (refer to FIG. 14(*a*)). In this state, as shown in FIG. 14(*b*), the second upper mold 52 which has an arc surface formed at an end to be the same in diameter as the core 14 is moved down along the interior of the outer mold 40 to press the foundation layer powder 50 and the abrasive grain layer powder 45 at a time. As a result, there is formed an arc-shaped wheel chip 11 in which the foundation layer 13 is bodily press-formed to be placed on the inner side of the abrasive grain layer 12 and which has opposite ends in the wheel circumferential direction parallel and inclined by the inclination angle α relative to the wheel circumferential direction.

Figure 15:
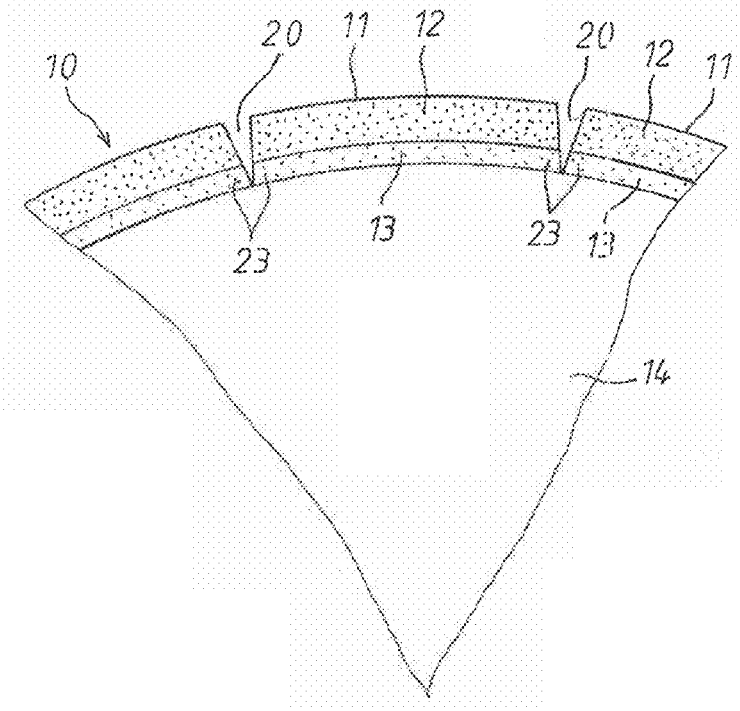
FIG. 15 is a view showing a part of an obliquely grooved grinding wheel in which wheel chips whose opposite end surfaces in the wheel circumferential direction are parallel are adhered to a core.

Thereafter, the second upper mold 52 is moved up, and the wheel chip 11 is taken out of the outer mold 40 and the lower mold 43. After being baked, the wheel chips 11 are adhered to the core 14, as shown in FIG. 15. Each wheel chip 11 has been press-formed to have their opposite ends in the wheel circumferential direction parallel to each other, and thus, in the stated that it is adhered to the core 14, the foundation layer 13 protrudes on the small diameter side from the abrasive grain layer 12 in the wheel circumferential direction to form protruding portions 23. Accordingly, when the wheel chips 11 are adhered to the core 14 with adjoining foundation layers 13 being in contact, an oblique groove 20 inclined by the inclination angle α relative to the wheel circumferential direction is formed between adjoining wheel chips 11. Since the wheel chips 11 are press-formed to have their opposite end surfaces in the wheel circumferential direction parallel to each other in this manner, each foundation layer 13 is made to protrude on the small diameter side from the abrasive grain layer 12 in the wheel circumferential direction. Thus, it becomes possible to form the wheel chips 11 with the protruding portions 23 in an ordinary manner, easily and at a low cost by using the outer mold 40 being parallel at the opposite side surfaces thereof.

Figure 16:
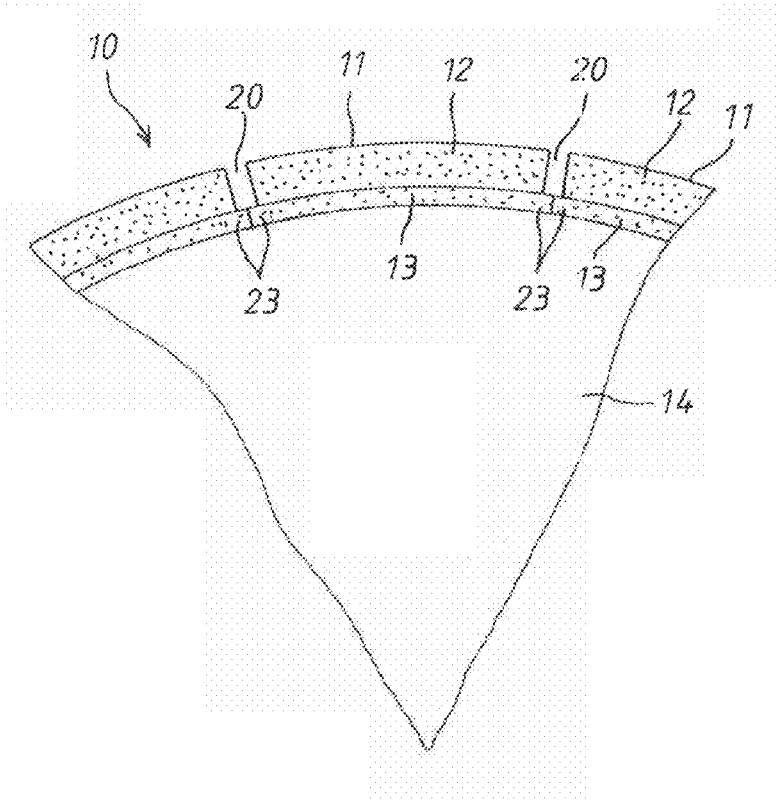
FIG. 16 is a view showing wheel chips each with protruding portions formed at the opposite ends of a foundation layer.

Although in the foregoing embodiment, each wheel chip 11 has the protruding portion 23 which protrudes one end in the wheel circumferential direction of the foundation layer 13 stepwise from the abrasive grain layer 12 in the wheel circumferential direction, the foundation layer 13 may have protruding portions 23 formed at opposite ends thereof in the wheel circumferential direction to protrude stepwise from the abrasive grain layer 12 in the wheel circumferential direction, as shown in FIG. 16.

Figure 17:
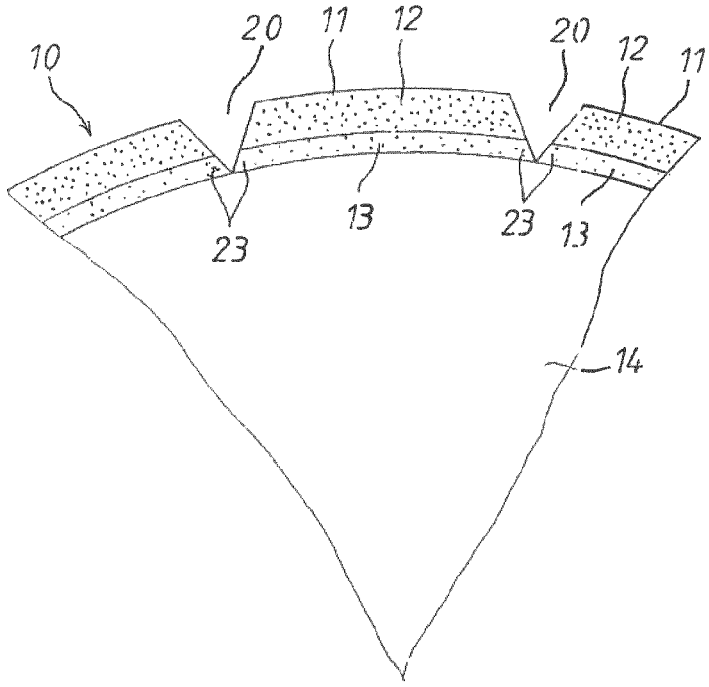
FIG. 17 is a view showing wheel chips in which protruding portions are formed at a foundation layer by inclining each wheel chip to protrude longer on a smaller diameter side in the wheel circumferential direction.

Although in the foregoing embodiment, each foundation layer 13 has the protruding portion 23 formed by being protruded stepwise from the abrasive grain layer 12 in the wheel circumferential direction, each wheel chip 11 may have protruding portions 23 which as shown in FIG. 17, are formed at the foundation layer 13 by being inclined so that at least one end surface in the wheel circumferential direction is protruded longer in the wheel circumferential direction on the smaller diameter side. In this case, the plurality of wheel chips 11 are adhered to the core 14 in such an arrangement that an oblique groove 20 is formed between adjoining abrasive grain layers 12 by contacting the protruding portion 23 of each wheel chip 11 with the foundation layer 13 of an adjoining wheel chip 11 and that at least one oblique groove 20 crosses the grinding point P independently of the rotational phase of the grinding wheel 10.

In the foregoing embodiment, it is the case that the width of the workpiece W is narrower than the width of the grinding wheel 10, in which case the specifications of the oblique grooves 20 are calculated on the assumption that the axial length of the grinding point P is equal to the width of the workpiece W. However, it may be the case that the width of the workpiece W is wider than the width of the grinding wheel 10, in which case the specifications of the oblique grooves 20 may be calculated on the assumption that the axial length of the grinding point P is equal to the width of the grinding wheel 10.

Although in the foregoing embodiment, the plurality of baked wheel chips 11 are arranged so that at least two oblique grooves 20 cross the grinding point P independently of the rotational phase of the grinding wheel 10, an arrangement may be made to make at least one oblique groove 20 cross the grinding point P.

Figure 18:
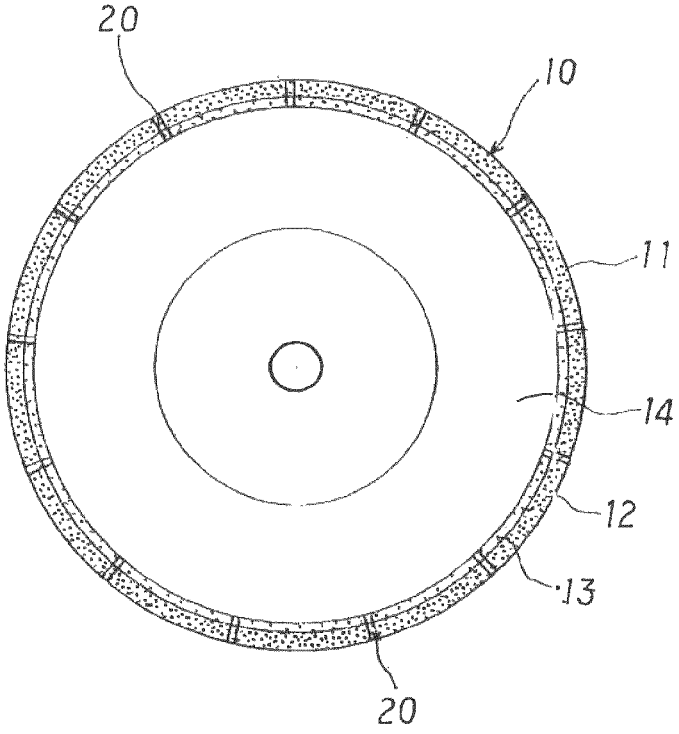
FIG. 18 is a general view of a grinding wheel composed of segmented wheel chips, showing a second embodiment according to the present invention.

Next, a second embodiment according to the present invention will be described with reference to the drawings. A grinding wheel 10 including segmented wheel chips 11 manufactured in a manufacturing method in the second embodiment differs from the grinding wheel in the first embodiment in a respect that as shown in FIG. 18, oblique grooves 20 pass through the foundation layers 13 to reach the core 14. Other constructions are the same as described above and therefore, are omitted from being described.

In the manufacturing method for this grinding wheel 10, a plurality of wheel chips 11 are press-formed to take the form of a parallelogram and are adhered to the outer circumference of a core 14 each with a clearance relative to the next thereto so that facing oblique end surfaces of adjoining wheel chips 11 form inner side walls of an oblique groove therebetween.

Figure 19:
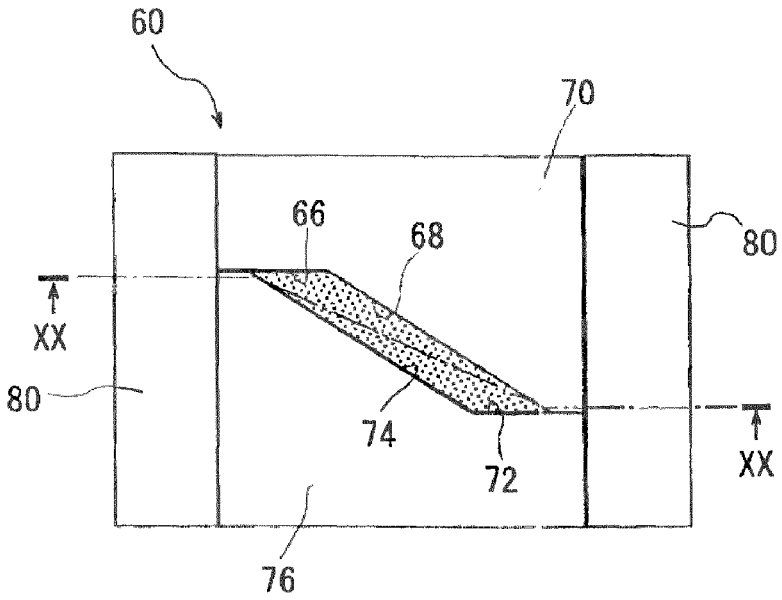
FIG. 19 is a top schematic view of a forming mold used in the same embodiment.
Figure 20:
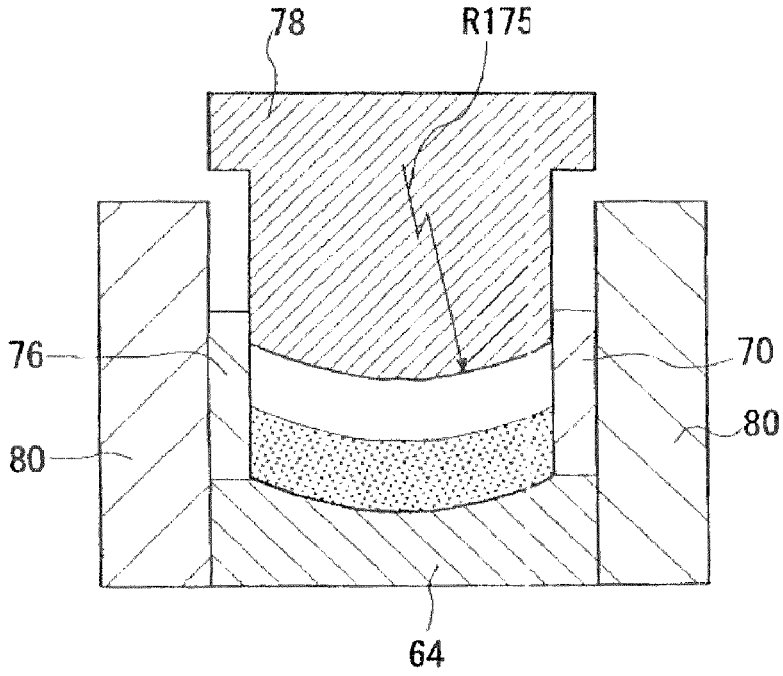
FIG. 20 is a cross-section taken along the line XX-XX in FIG. 19 of the mold.
Figure 21B:
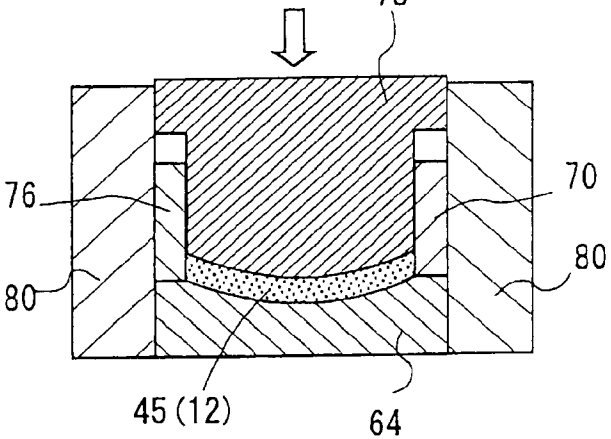
FIGS. 21(*a*)-21(*d*) are views showing the steps of manufacturing wheel chips in the second embodiment.
Figure 21D:
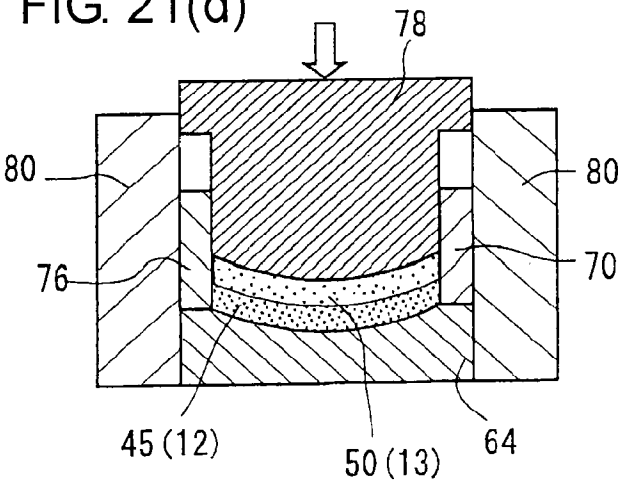
Figure 21A:
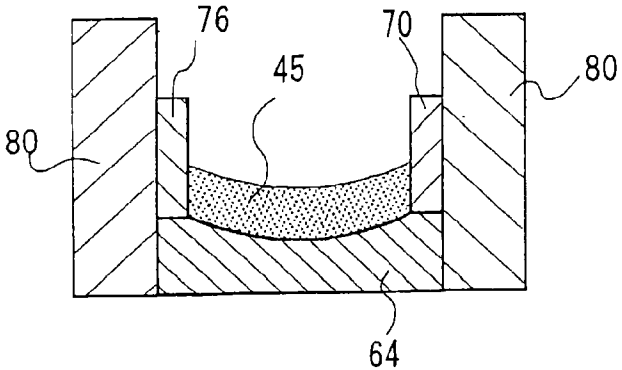
Figure 21C:
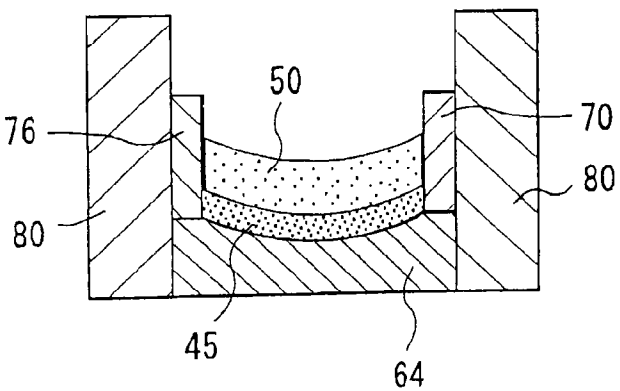

A method of manufacturing the wheel chips 11 will be described with reference to FIGS. 19 through 21. As shown in FIGS. 19 and 20, a press-forming mold 60 for forming the wheel chips 11 is provided with a lower mold 64 having as an upper surface a grinding surface forming wall 62 being an arc shape corresponding to the grinding surface 15 of the wheel chip 11 to be formed, a one-side outer mold 70 provided with a one-side lateral surface forming wall 66 corresponding to a one-side lateral surface parallel to the wheel circumferential direction of the wheel chip 11 to be formed and a one-side end surface forming wall 68 corresponding to a one-side end surface in the wheel circumferential direction (an end surface ahead in the wheel rotational direction) of the wheel chip 11 inclined relative to the wheel circumferential direction, an other-side outer mold 76 provided with an other-side lateral surface forming wall 72 corresponding to an other-side lateral surface parallel to the wheel circumferential direction of the wheel chip 11 to be formed and an other-side end surface forming wall 74 corresponding to the other end surface in the wheel circumferential direction (an end surface behind in the wheel rotational direction) of the wheel chip 11 inclined relative to the wheel circumferential direction, and an upper mold 78 formed to take the form of a parallelogram in the cross-section of a pressing portion and having as an end an arc surface being the same in diameter as the core 14. The lower mold 64 and the outer molds 70, 76 are firmly secured to a frame member 80. The lateral surface forming walls 66, 72 and the end surface forming walls 68, 74 of the outer molds 70, 76 are formed by, e.g., machining or the like.

First of all, as shown in FIG. 21(*a*), abrasive grain layer powder 45 being a mixture of superabrasive grains, a bonding agent, aggregate and the like which constitute the abrasive grain layer 12 is filled on the lower mold 64, and leveling is done to make the abrasive grain layer powder 45 uniform in thickness.

Then, as shown in FIG. 21(*b*), the upper mold 78 is downwardly moved into the outer molds 70, 76, and the abrasive grain layer powder 45 is provisionally pressed to preform the abrasive grain layer 12 to an arc shape.

Then, as shown in FIG. 21(*c*), the foundation layer powder 50 including the foundation particles 19 is filled on the upper side of the provisionally press-formed abrasive grain layer powder 45, and leveling is carried out to make the foundation layer powder 50 uniform in thickness.

Then, as shown in FIG. 21(*d*), the upper mold 78 having as an end an arc surface formed to be equal in diameter (e.g., R175) to the core 14 is moved down along the interiors of the outer molds 70, 76 to press the foundation layer powder 50 and the abrasive grain layer powder 45 at a time, whereby the foundation layer 13 is formed to be placed on the inner side of the abrasive grain layer 12.

Then, the upper mold 78 is moved up, and the wheel chip 11 is taken out of the outer molds 70, 76 and the lower mold 64, whereby a green wheel chip 11 is formed. A plurality of green wheel chips 11 are manufactured in the same manner as described above.

Figure 22:
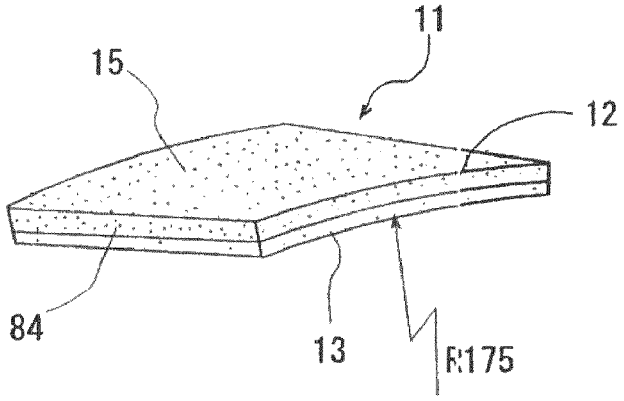
FIG. 22 is a view showing a wheel chip manufactured in a manufacturing method in the second embodiment.

Then, the green wheel chips 11 are baked in a furnace. Where a vitrified bond is used as the bonding agent, the baking is carried out in a range of, e.g., 700 to 1000° C. In this way, the manufacturing of the wheel chips 11 is completed, whereby as shown in FIG. 22, the wheel chips 11 are formed each of which takes the form of a parallelogram as viewed from above and which is curved like an arc shape as viewed from one side.

Figure 23:
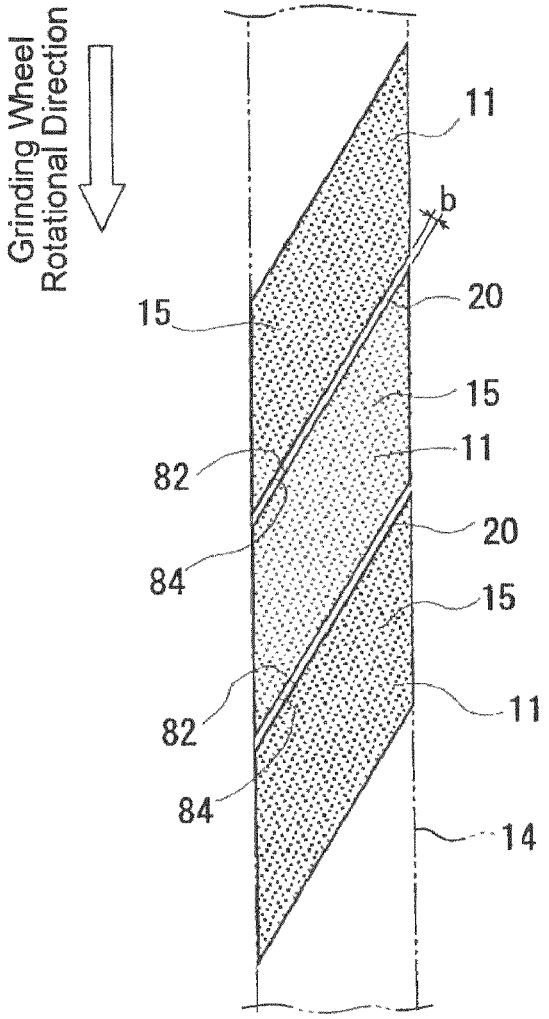
FIG. 23 is a view showing the state in which wheel chips are adhered to a core.
Figure 24:
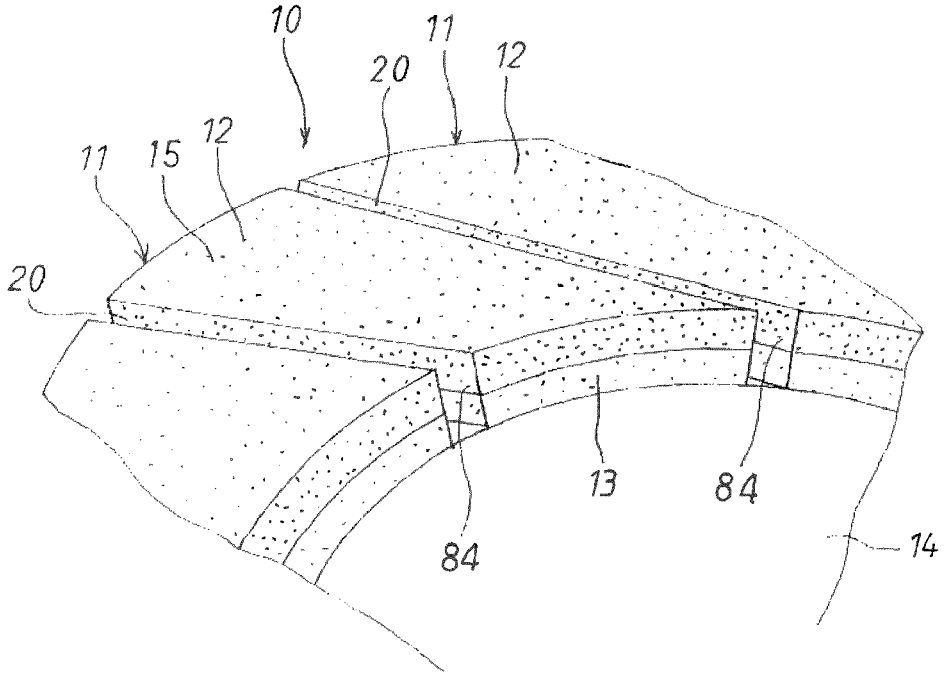
FIG. 24 is a perspective view of the wheel chips.

Then, as shown in FIG. 23, the plurality of wheel chips 11 are adhered in turn to the outer circumference of the disc-like core 14 for the grinding wheel 10 in such an arrangement that a clearance becoming an oblique groove 20 of a groove width b is provided between a rearward end surface 82 of a wheel chip 11 adjoining on the forward side in the wheel rotational direction and a forward end surface 84 of another wheel chip 11 adjoining to the wheel chip 11 on the rearward side in the wheel rotational direction. In this way, the grinding wheel 10 is formed in which the oblique grooves 20 reach the core 14, as shown in FIG. 24.

In this manufacturing method, the press-forming forms the wheel chips 11 each having, in addition to the grinding surface 15 of an arc shape, oblique end surfaces 82, 84 which constitute inner side walls of the oblique groove 20 when adhered to the core 14. Therefore, only by adhering the wheel chips 11 to the core 14 with the clearance provided between the facing end surfaces 82, 84 of adjoining wheel chips 11, it becomes possible to easily form the grinding wheel with the oblique grooves 20. Since the oblique grooves 20 are not cut by machining on the difficult-to-machine grinding surface 15 of the baked wheel chips 11 having been adhered to the core 14, it can be realized to provide an obliquely grooved grinding wheel with which it does not occur that the retention force of the superabrasive grains is weakened by machining and which is possible to shorten the manufacturing period of time and low in cost.

The operation of the grinding wheel 10 manufactured in the aforementioned manufacturing method is the same as that in the first embodiment, and therefore, description regarding the operation is omitted.

Next, a third embodiment according to the present invention will be described with reference to the drawings. A grinding wheel 10 including segmented wheel chips 11 manufactured in a manufacturing method in the third embodiment is the same as the grinding wheel in the second embodiment shown in FIG. 18, and therefore, description regarding the grinding wheel 10 is omitted.

In the manufacturing method for the grinding wheel 10, after being press-formed to a rectangular shape, a plurality of wheel chips 11 are adhered to the outer circumference of the core 14 in such an arrangement that they are provided with clearances therebetween and are inclined relative to the wheel circumferential direction to make the facing lateral surfaces of adjoining wheel chips 11 form inner side walls of an oblique groove 20, and projecting portions of the wheel chips which project out beyond the width of the core 14 are eliminated by machining.

The method of manufacturing the wheel chips 11 used in manufacturing the grinding wheel 10 will be described with reference to FIGS. 25 through 29.

Figure 25:
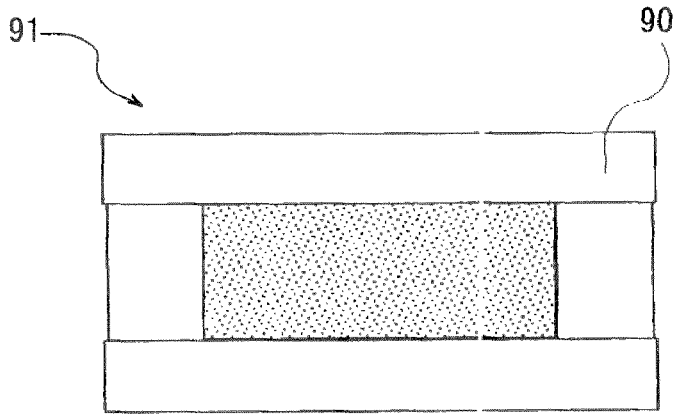
FIG. 25 is a top schematic view of a forming mold used in a third embodiment.
Figure 26:
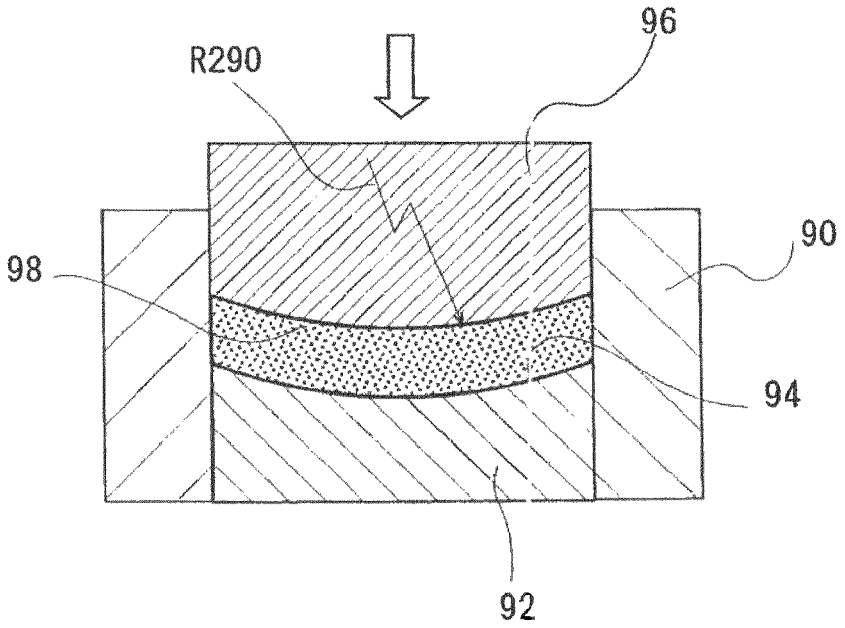
FIG. 26 is a cross-sectional view of the mold in the third embodiment.

As shown in FIG. 25, a lower mold 92 is fitted at an inner bottom portion of a rectangular outer mold 90, and as shown in FIG. 26, an arc-shaped concave surface 94 for press-forming an arc shape surface of a wheel chip 11 constituting the outer diameter of the grinding wheel is formed on the upper surface of the lower mold 92. There is provided an upper mold 96 movable downward along the interior of the outer mold. An arc surface 98 of a diameter (e.g., R290 mm) which is somewhat greater than the diameter (e.g., R175 mm) of the core 14 is formed on an end of the upper mold 96.

As shown in FIG. 27(*a*), abrasive grain layer powder 45 being a mixture of superabrasive grains, a bonding agent, aggregate and the like which constitute the abrasive grain layer 12 is filled on the upper side of the lower mold 92, and leveling is carried out to make the abrasive grain layer powder 45 uniform in thickness.

Then, as shown in FIG. 27(*b*), the upper mold 96 is moved down into the outer mold 90, and the abrasive grain layer powder 45 is provisionally pressed to preform the abrasive grain layer 12 to an arc shape.

Then, as shown in FIG. 27(*c*), foundation layer powder 50 including foundation particles 19 is filled on the upper side of the provisionally press-formed abrasive grain layer powder 45, and leveling is carried out to make the foundation layer powder 50 uniform in thickness.

Then, as shown in FIG. 27(*d*), the upper mold 96 is moved down into the outer mold 90 to press the foundation layer powder 50 and the abrasive grain layer powder 46 at a time, and the foundation layer 13 is bodily formed to be placed on the inner side of the abrasive grain layer 12, whereby a wheel chip 11 of an arc shape is press-formed. At this time, a contact surface 101 at which the foundation layer 13 of the wheel chip 11 is to contact the outer circumference of the core 14 is formed to R 290 mm determined by the diameter at the end of the upper mold 96.

Then, the upper mold 96 is moved up, and the wheel chip 11 is taken out of the outer mold 90 and the lower mold 92.

Then, the wheel chips 11 are baked in a furnace. Where a vitrified bond is used as the bonding agent as is the case of the present embodiment, the baking is carried out in a range of, e.g., 700 to 1000° C. In this way, as shown in FIG. 28, the wheel chips 11 are formed each of which has the contact surface 101 of the diameter R290 mm and a pair of mutually parallel end surfaces 100 and takes the form of a rectangular as viewed from above and an arc shape as viewed from one side.

Then, the baked wheel chips 11 are adhered to the outer circumference of the core 14 in such an arrangement that the lateral end surfaces 100 of each wheel chip 11 are inclined relative to the wheel circumferential direction and that a clearance of a groove width b is provided to make the facing lateral end surfaces 100 of the wheel chips 11 form inner side walls of an oblique groove 20.

Figure 29:
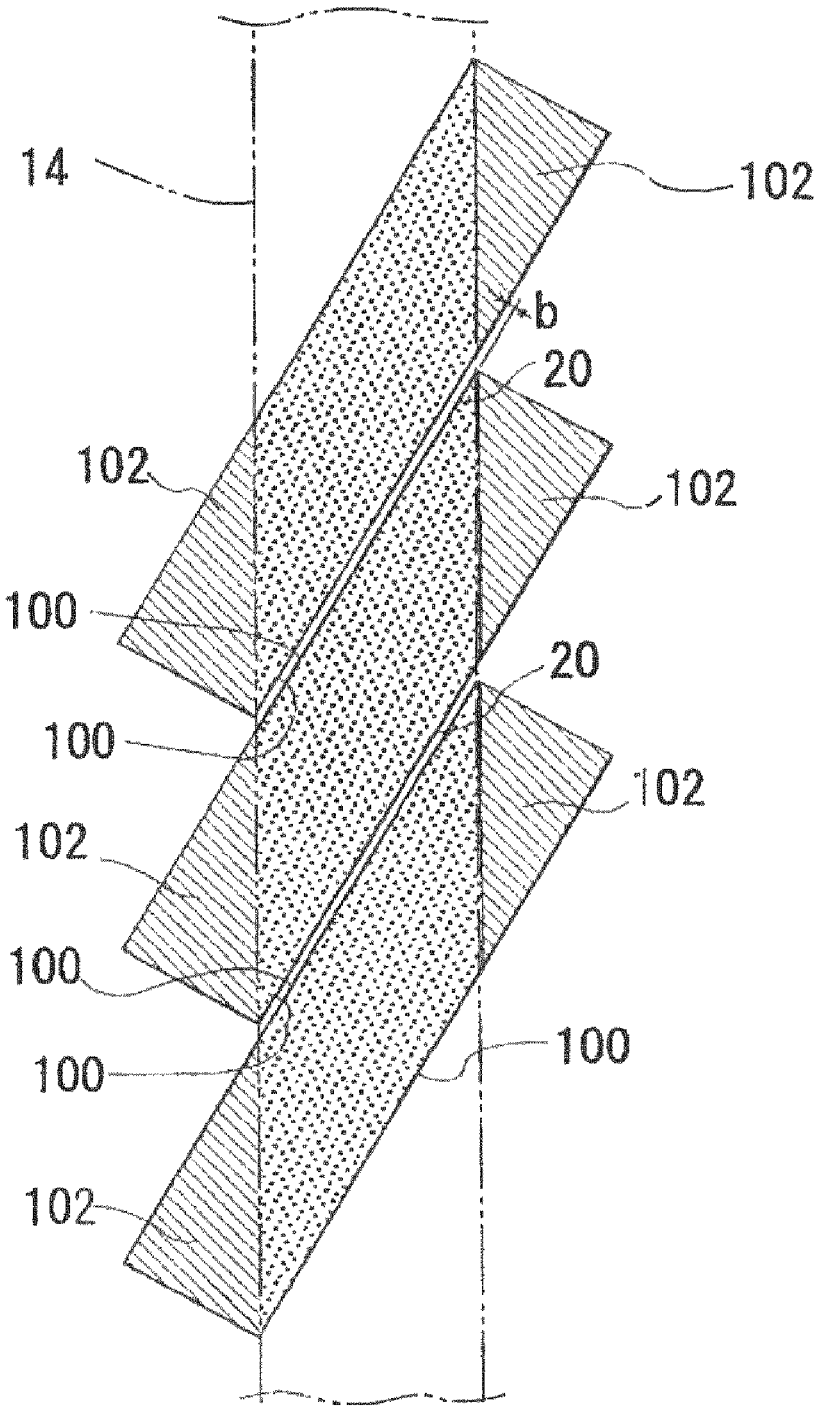
FIG. 29 is a view showing the state in which wheel chips are adhered to a core in the third embodiment and in which projecting portions thereof are eliminated.

Thereafter, as shown in FIG. 29, the projecting portions 102 of the adhered wheel chips which portions project out beyond the axial width of the core 14 are eliminated by being cut off by, e.g., a cutting machine.

In the foregoing manufacturing method, it is possible to press-form the wheel chips 11 easily without using a special press-forming mold. Further, by making the contact surface 101 of each wheel chip 11 as an arc surface of the diameter which is greater than the outer diameter of the core 14, it becomes possible to adhere the wheel chips 11 to the outer circumference of the core 14 in such an arrangement that the clearance generated between the contact surface 101 and the outer circumferential surface of the core 14 is suppressed to be small and that the lateral end surfaces 100 of each wheel chip 11 are inclined relative to the wheel circumferential direction. Furthermore, although of the adhered wheel chips 11, the projecting portions 102 projecting out beyond the width of the core 14 are eliminated by machining, the oblique grooves 20 provided on the grinding surface 15 of the wheel chips 11 are not cut by machining. Thus, it does not occur that the retention force of the superabrasive grains on the grinding surface 15 which are used mainly during grinding operations is not weakened by machining.

The operation of the grinding wheel 10 manufactured in the aforementioned manufacturing method is the same as that in the first embodiment, and therefore, description regarding the operation of the grinding wheel is omitted.

Although in the foregoing embodiment, the diameter of the contact surface 101 of each wheel chip is set to R290 mm for the diameter R175 mm of the core 14, the present invention is not limited to these values. It is possible to choose these values properly in dependence on the angle at which the wheel chips are inclined as well as on the diameter of the core.

INDUSTRIAL APPLICABILITY

Applicability is directed to an obliquely grooved grinding wheel for effectively leading coolant along oblique grooves to a grinding point and the use in manufacturing the obliquely grooved grinding wheel at a low cost without weakening the retention force of superabrasive grains on a grinding surface.

The invention claimed is:

1. An obliquely grooved grinding wheel in which a plurality of wheel chips each composed of an abrasive grain layer containing superabrasive grains and a foundation layer are adhered to a core attached to a wheel spindle carried by a wheel head of a grinding machine to be drivingly rotatable about a rotational axis and in which a grinding surface formed on the abrasive grain layers grinds a workpiece, drivingly rotatably supported by a workpiece support device of the grinding machine, in contact at a grinding point, wherein:

the wheel chip has both ends in a wheel circumferential direction inclined relative to the wheel circumferential direction;

the foundation layer has a protruding portion formed to protrude from the abrasive grain layer in the wheel circumferential direction; and the plurality of wheel chips are adhered to the core so that the protruding portion contacts the foundation layer of an adjoining wheel chip to form an oblique groove between adjoining abrasive grain layers.

2. The obliquely grooved grinding wheel as set forth in claim 1, wherein:

the wheel chip has the protruding portion which is formed by protruding at least one end in the wheel circumferential direction of the foundation layer from the abrasive grain layer stepwise in the wheel circumferential direction; and each wheel chip is adhered to the core with the protruding portion contacting the foundation layer of an adjoining wheel chip.

3. The obliquely grooved grinding wheel as set forth in claim 1, wherein the protruding portions are formed to protrude a small diameter side of the foundation layer from the abrasive grain layer in the wheel circumferential direction by press-forming the wheel chip to make both end surfaces thereof in the wheel circumferential direction parallel to each other.

4. The obliquely grooved grinding wheel as set forth in claim 1, wherein:

the wheel chip has the protruding portion which is formed by inclining at least one end surface in the wheel circumferential direction to protrude longer on a smaller diameter side in the wheel circumferential direction; and each wheel chip is adhered to the core with the protruding portion contacting the foundation layer of an adjoining wheel chip.

* * * * *